US011905097B2

(12) United States Patent
Olmstead et al.

(10) Patent No.: US 11,905,097 B2
(45) Date of Patent: Feb. 20, 2024

(54) MULTI-COMPARTMENT BEVERAGE CONTAINER FOR DISPENSING A MIXED BEVERAGE

(71) Applicant: o6 Innovations Inc., Burien, WA (US)

(72) Inventors: Ryan S. Olmstead, Burien, WA (US); Dayne M. Olmstead, Burien, WA (US); Jess A. Olmstead, Burien, WA (US)

(73) Assignee: o6 Innovations Inc., Burien, WA (US)

( * ) Notice: Subject to any disclaimer, the term of this patent is extended or adjusted under 35 U.S.C. 154(b) by 62 days.

(21) Appl. No.: 17/372,224

(22) Filed: Jul. 9, 2021

(65) Prior Publication Data

US 2022/0009697 A1 Jan. 13, 2022

Related U.S. Application Data

(60) Provisional application No. 63/050,574, filed on Jul. 10, 2020.

(51) Int. Cl.

| | |
|---|---|
| ***B65D 81/32*** | (2006.01) |
| ***B65D 51/16*** | (2006.01) |
| ***B65D 47/06*** | (2006.01) |
| ***B65D 51/24*** | (2006.01) |

(52) U.S. Cl.

CPC ..... *B65D 81/3205* (2013.01); *B65D 47/06* (2013.01); *B65D 51/1633* (2013.01); *B65D 51/24* (2013.01)

(58) Field of Classification Search

CPC ..... B65D 51/2892; B65D 51/3211; B65D 51/28; B65D 51/3205; B65D 51/1633; B65D 51/24; B65D 81/32; B65D 81/3211; Y10S 215/08; A61J 1/202; A61J 1/2024; A61J 1/2027; A61J 1/2093

USPC ..... 215/DIG. 8, 6; 222/145.5, 145.1; 216/219

See application file for complete search history.

(56) References Cited

U.S. PATENT DOCUMENTS 2,781,141 A * 2/1957 Lucien ..... B65D 51/2885 215/DIG. 8
3,463,361 A 8/1969 Cook et al.
3,591,089 A * 7/1971 Cronan ..... B65D 83/687 222/129

(Continued)

FOREIGN PATENT DOCUMENTS

WO 0100521 A1 1/2001

OTHER PUBLICATIONS

Coxworth, Ben , "Review: Infuze Gives Hydration Packs and Water Bottles a Downstream Energy Boost", https://newatlas.com/infuze-hydro-vessel-review/59180/, dated Apr. 5, 2019, 9 pages.

*Primary Examiner* — Steven A. Reynolds
*Assistant Examiner* — Prince Pal
(74) *Attorney, Agent, or Firm* — Dorsey & Whitney LLP

(57) ABSTRACT

A mixing cup for mixing and dispensing a mixed beverage is described. The mixing cup is designed to attach externally to a primary container that holds a primary liquid. The mixing cup contains a secondary liquid in fluid separation from the primary liquid until the two liquids are mixed, as a result of the user drawing the primary liquid from the primary container, in a mixing chamber of the mixing cup and the mixture is dispensed to the user. The flow of the secondary liquid into the mixing chamber may be adjustable by the user.

20 Claims, 13 Drawing Sheets

(56) References Cited

U.S. PATENT DOCUMENTS 3,966,089 A * 6/1976 Klingaman ..... B67B 7/28 222/88
4,121,772 A * 10/1978 Cronan ..... B65D 83/687 222/129
5,361,918 A * 11/1994 Mason ..... B65D 51/28 215/11.1
5,794,802 A * 8/1998 Caola ..... A61J 1/2093 215/11.1
5,890,624 A * 4/1999 Klima ..... B05B 11/0081 222/129
5,984,141 A 11/1999 Gibler
6,010,034 A * 1/2000 Walthers ..... A47G 19/2266 239/289
6,503,222 B2 1/2003 Lo
6,540,112 B1 4/2003 Studnik
6,705,490 B1 3/2004 Lizerbram et al.
7,017,735 B2 3/2006 Carlson
7,533,786 B2 5/2009 Woolfson et al.
7,854,336 B2 12/2010 Kerner et al.
8,142,827 B2 3/2012 Bell
8,147,120 B2 4/2012 Renna et al.
8,152,017 B2 4/2012 Lizerbram et al.
8,302,770 B2 11/2012 Valentine
8,302,803 B1 11/2012 Greenberg et al.
8,365,960 B1 2/2013 Kalaouze
8,544,688 B2 10/2013 Ballentine
8,657,158 B1 2/2014 Snell
8,684,173 B2 * 4/2014 Otsuka ..... B65D 51/2864 215/DIG. 8
8,960,424 B1 * 2/2015 Anderson ..... B65D 51/2835 206/219
9,650,189 B1 5/2017 Lawson et al.
9,795,242 B2 10/2017 Waggoner et al.
9,986,872 B2 6/2018 Shalvi et al.
10,029,831 B2 * 7/2018 Lee ..... B65D 47/243
10,093,462 B2 10/2018 Mcarthur
10,093,479 B2 10/2018 Fuchs et al.
10,486,869 B2 11/2019 Brook-chrispin et al.
10,631,675 B1 * 4/2020 Ellsworth ..... B65D 51/24
10,675,597 B2 * 6/2020 Mutschler ..... B01F 35/7131
11,198,551 B2 * 12/2021 Fyfe ..... B05B 7/0408
11,458,443 B2 * 10/2022 Noall ..... B01F 25/312
2002/0020636 A1 * 2/2002 Bergamini ..... A61J 1/2093 206/219
2005/0183587 A1 * 8/2005 Chia Salido ..... A61J 1/2093 99/483
2006/0283726 A1 * 12/2006 McCloud ..... B65D 81/3211 206/219
2007/0075079 A1 4/2007 Stokes
2008/0011624 A1 * 1/2008 Robb ..... B65D 51/28 206/219
2008/0283537 A1 11/2008 Smith et al.
2009/0272747 A1 * 11/2009 Kalaouze, Jr. ..... B65D 81/3222 220/500
2009/0321286 A1 * 12/2009 Frutin ..... B65D 51/2892 206/219
2010/0044254 A1 2/2010 Romeo
2010/0108715 A1 * 5/2010 Santagiuliana .... B65D 51/2835 206/219
2011/0113972 A1 * 5/2011 Tatera ..... B01F 23/23611 99/323.1
2012/0031917 A1 * 2/2012 Loging ..... A47G 19/2272 220/710.5
2012/0305559 A1 * 12/2012 Steininger ..... B65D 47/0885 220/259.2
2013/0200028 A1 * 8/2013 Vaught ..... A61J 9/008 215/6
2014/0103037 A1 * 4/2014 Strominger ..... B65D 43/0231 220/523
2014/0246463 A1 * 9/2014 Poul ..... A47G 19/14 222/472
2015/0129613 A1 5/2015 Vuong
2015/0307265 A1 10/2015 Winn et al.
2017/0216142 A1 * 8/2017 Mittal ..... A61J 1/2027
2017/0296988 A1 10/2017 Waggoner et al.
2018/0022527 A1 * 1/2018 Leibovitch ..... A23L 2/39 206/219
2018/0044201 A1 * 2/2018 Metaxatos ..... B65D 47/06
2018/0079552 A1 3/2018 Ayeni
2018/0099805 A1 * 4/2018 Johnson ..... B65D 81/3205
2018/0113017 A1 * 4/2018 Hoefte ..... B65D 47/0804
2019/0208948 A1 7/2019 Perrelli et al.
2019/0282979 A1 * 9/2019 Noall ..... B65D 81/3222
2019/0308144 A1 10/2019 Mutschler et al.
2019/0367217 A1 12/2019 Sitwell et al.
2019/0380526 A1 * 12/2019 Beausire ..... A61J 1/2093
2020/0078270 A1 * 3/2020 Clark ..... A61J 9/008
2020/0154931 A1 * 5/2020 Spagnolo ..... B65D 51/28
2021/0085566 A1 * 3/2021 Keenan ..... B01F 21/15
2021/0163214 A1 * 6/2021 Yan ..... B65D 33/2508
2021/0282585 A1 * 9/2021 Lee ..... A47J 31/20

* cited by examiner

MULTI-COMPARTMENT BEVERAGE CONTAINER FOR DISPENSING A MIXED BEVERAGE

CROSS-REFERENCE TO RELATED APPLICATION(S)

This application claims priority to 63/050,574 filed Jul. 10, 2020, which is incorporated herein by reference, in its entirety, for any purpose.

TECHNICAL FIELD

This disclosure relates generally to a secondary beverage container that attaches to a primary container to form a multi-compartment beverage container for dispensing a mixture of the liquids in the primary and secondary containers.

BACKGROUND

It is sometimes desirable to create a mixed beverage by combining a primary beverage liquid, such as soda or juice, with a secondary liquid such as liquid flavoring, medicine or alcohol. The primary beverage liquid is often contained in a standard beverage can (e.g., an aluminum can) or another beverage container such as a plastic bottle. Traditionally, the components of the mixed beverage would be individually measured, poured into a separate glass, mixed, and consumed from the glass. In some cases, it may be desirable to mix the primary liquid with the secondary liquid as it is dispensed from the primary liquid's original container, thereby avoiding the additional steps of measuring, pouring, mixing, and provision of additional serving container that are typically associated with conventional preparation of mixed beverages. Some attempts have been made to provide solutions, but some such existing solutions lack the ability to adjust the amount of flavoring in the mixture. Others are often complex, difficult to manufacture, and often require a custom primary container for proper operation. Accordingly, designers and manufacturers of beverage containers and associated dispensing devices continue to seek improvements thereto.

SUMMARY

The present disclosure describes a mixing cup (also referred to as mixing container or secondary container) which is designed to hold a secondary (also referred to as flavoring or additive) liquid separately from a primary liquid contained in a primary container, and which mixes the two liquids as the primary liquid is dispensed from the primary liquid container. Embodiments of the mixing cup are designed to operatively couple to a primary liquid container which is a standard beverage container (e.g., a standard beverage can, or a plastic or glass bottle), which may be the original container in which the primary liquid is enclosed as marketed/sold to a consumer. As such, the dispensing of a mixed beverage with the use of a mixing cup according to the present disclosure avoids the need to use any additional containers or tools for preparing a mixed beverage, at a desired flavoring concentration.

One or more components of the secondary container may be formed as rigid components. These rigid components may be manufactured using any suitable technique, for example by being injection molded from a plastic material such as polypropylene (PP), styrene acrylonitrile (SAN), or polyethylene terephthalate glycol (PETG). Other suitable materials, such as glass, metal, or a composite material, and other suitable techniques, such as machining, laminating, or additive manufacturing (e.g., 3D printing) may be used in some embodiments. Certain features of some of the embodiments herein may address limitations of known manufacturing processes, such as the injection molding process, for example by reducing or substantially eliminating undercut regions and/or facilitating appropriate draft angles for ease of manufacture. The mixing cup is configured such that liquid in the primary container or "primary liquid" is mixed with the liquid in the secondary container or "secondary liquid" only when dispensed. In use, a user draws both liquids simultaneously through a mixing chamber and out of the container by sucking on the dispensing outlet (e.g., spout) of the secondary container. As they are drawn from their respective containers, the primary and secondary liquids are entrained and mixed in the mixing chamber as they are dispensed to the user.

In embodiments of the present disclosure, the mixing cup (or secondary container) includes a substantially rigid cup-shaped body, referred to herein as a rigid main body, which forms a chamber or reservoir (referred to herein as secondary chamber) for containing the secondary liquid. In some embodiments, at least a portion of the main body, such as the upper portion which is associated with the secondary chamber, is see-through (e.g., transparent or translucent) and includes a liquid level indicator on or visible through the outer wall of the see-through portion. In some embodiments, substantially the full rigid main body may be made from a see-through material, e.g., a plastic of sufficient transparency or translucency to enable a user to visualize the liquid level in relation to the liquid level indicator.

The secondary container may be configured to substantially sealingly enclose the secondary liquid in the secondary chamber. As such, a secondary container according to embodiments herein includes a cap or lid assembly (or simply lid), which is operatively coupled to the main body to substantially seal the secondary liquid within the secondary chamber. In some embodiments, the lid is removably coupled to the main body, to allow a user to remove the lid to access the interior of the secondary container, such as to clean, service or refill the secondary container. The lid and main body may be coupled via a threaded or a snap-fit coupling. Other suitable coupling mechanism such as hooks, latches, fasteners, or magnets configured to securely attach the lid to the main body may alternatively or additionally be used. In some embodiments, the lid may be irremovably coupled to the main body, for example bonded thereto such that the lid is not removable or intended to be removed by an end user. A mixing cup according to some such embodiments may be for single use. In other examples, a separate, selectively sealable opening may be provided, e.g., in the lid, for re-filling a mixing cup with a fixed lid. In some embodiments, the lid may include one or more accessory attachment features, for example for attaching a name tag, a drink identifier, a decoration or other accessory. The accessory attachment features may be implemented by one or more holes, posts, hooks, loops, magnetically attracting elements or the like. Additionally, the secondary container may be provided with a means for reducing or substantially stopping the flow of the secondary liquid out of the secondary chamber. In embodiments of the present disclosure, this means may be implemented as a flow control mechanism operable to adjust the amount of secondary liquid dispensed from the secondary container down to substantially preventing any secondary liquid from being dispensed under normal suction force applied by a user or if the multi-compartment container is tipped over.

The mixing cup, according to some embodiments, is configured to attach to the primary container externally and to form, together with the primary container, a multi-compartment container. In some embodiments, the coupling mechanism may be configured to couple the secondary container to the primary container such that the secondary chamber is positioned entirely outside of the liquid holding chamber of the primary container. In some such embodiments, the secondary chamber is arranged in series with the primary liquid chamber such as by having the secondary container stacked on top of the primary container when coupled thereto. In some embodiments, a portion of the secondary container may be positioned inside the primary container.

As noted above, the primary container may be a standard aluminum beverage can, a plastic or glass bottle, a standard jar (e.g., mason jar), or another type of standard beverage container. In some embodiments, the primary container may be a mug, tumbler, glass, or other existing container that has a non-smooth (or contoured) rim, for example a rim with a lip, thread or other feature(s) protruding from the rim) that may enable external attachment thereto. The coupling mechanism of the secondary container may be configured to interface with standard threaded top ends of conventional bottles, tumblers, or other pre-existing containers. The secondary container may include a coupling mechanism or interface, in some cases a set or kit of different coupling interfaces removably attachable to a main body, that enables the secondary container to couple to one or more existing containers, such as a standard beverage can, a bottle, a jar or other containers not specifically or purposefully designed for use with the secondary container. The coupling mechanism of the secondary container may be configured to snap-fit onto a variety of existing container that have a lip at their top side, such as the lip of a standard beverage can. In some embodiments, the secondary container may be attached to the primary container by a threaded coupling or by another suitable coupling mechanism. In some embodiments, magnetic attachments means may additionally or alternatively be used for coupling the primary and secondary containers.

In some embodiments, the coupling interface includes an annular wall, and a plurality of engagement features (e.g., flanges or teeth) extending radially inward from the annular wall, the plurality of flanges being configured to engage (e.g., hook under) a top-side lip of the existing container (e.g., standard beverage can). In some embodiments, the plurality of engagement features includes a first flange and a second flange extending radially inward from diametrically opposite locations of the annular wall. In some embodiments, the annular wall is resiliently deformable at a first location between the first and second flanges and a second location between the first and second flanges opposite the first location such that application of a radially inward force to the first and second locations increases the distance between the first and second flanges, which may facilitate snap-fitting the mixing cup to an existing container such as a beverage can. In some embodiments, the plurality of engagement features (e.g., first and second flanges) may be configured to enable engagement with a thread on the primary container upper rim. In some embodiments, the plurality of engagement features may include a plurality of teeth arranged in an array around the inner periphery of the annular wall. Other suitable coupling interfaces may be employed. In some embodiments, the main body of the mixing cup is positioned outside of the primary container when the mixing cup is attached thereto.

The coupling interface of the mixing cup may be configured to position the mixing cup above a top side of the primary container. In some embodiments, the coupling interface is provided on a side of the main body opposite the lid. In some embodiments, the coupling interface may be removably attached to the main body of the mixing cup. In other embodiments, the coupling interface may be fixedly attached, in some cases integrally formed with the main body. In some embodiments, the coupling interface includes a circumferential seal (e.g., an o-ring or other suitable gasket) that substantially seals a perimeter of an interstitial space between the primary and secondary containers when the primary and secondary containers are attached to one another.

The mixing cup includes a mixing chamber integrated in the lid. The mixing chamber is in fluid communication with the primary fluid container via a primary inlet and to the secondary chamber via a secondary inlet. The mixing cup also includes a dispensing outlet or spout and the mixing chamber may be located proximate to the spout such that mixing of the primary and secondary fluids occurs in close proximity to the location of dispensing of liquid(s) to the user. In some embodiments, the spout extends immovably from a top side of the lid. That is, the spout may be attached to the lid, in some cases integrally formed with the lid, to remain in a fixed position relative to the lid at all times. In some embodiments, the mixing chamber is located within the spout (e.g., provided in a lower/distal portion of the spout). The terms proximal and distal when used herein imply relative positioning to the user during normal use of the mixing cup. That is components that are described as proximal are located closer to the user than components described as distal during normal use of the mixing cup for dispensing a mixed beverage. In some embodiments the mixing chamber may be integrally formed with the spout forming a part of the spout, e.g., the lower or distal end of the spout. In some embodiments, the primary and secondary inlets to the mixing chamber may be arranged at opposite sides of the mixing chamber, which may facilitate improved mixing. By providing the two inlets on opposite sides, maximum separation of the two inlets may be achieved which may reduce the risk of cross contamination (e.g., primary liquid inadvertently back flowing into the secondary container or secondary liquid inadvertently back flowing into the primary container).

A primary liquid pickup tube extends from the base of the secondary container into the primary container. The primary liquid pick up tube may be a flexible tube and may extend from the secondary container to the base of the primary container. As such, the primary liquid can be drawn from the primary container without tipping the primary container. The secondary container may include a first or main pass-through for the primary liquid so that the primary liquid may be drawn from the primary container and through the secondary chamber without mixing with the secondary liquid until it reaches the mixing chamber in the lid. In some embodiments, the first pass-through is implemented as a rigid structure that passes through the interior of the secondary chamber and defines a channel connecting an opening on a bottom side of the rigid main body to a first opening in the lid. In some embodiments, the pass-through may be implemented using a non-rigid structure, such as a flexible tube, which may be connectable, in embodiments in which the lid is removable, to the opening in the lid prior to coupling the lid to the main body. In other embodiments, a flexible structure, such as a tube, may remain connected between the main body and the lid even when the lid is opened. In some such embodiments, the flexible structure (e.g., tube) may be longer than the height of the secondary chamber and may optionally be coiled to fit within the secondary chamber when the lid seals the secondary chamber. In some embodiments, in which a rigid pass-through structure is used, such rigid structure may be fixedly attached to, in some cases integrally formed with, the main body. The first pass-through, in the case of a rigid structure extending from the base of the main towards the lid, is positioned within the secondary chamber such that its outlet aligns with the first opening in the lid. The opening of the first pass-through at the base of the mixing cup may be provided with a protruding structure (e.g., barb) for connecting to the primary liquid pickup tube. The barb may protrude from the base such that it extends below the bottom or distal side of the mixing cup. In other embodiments, it may protrude from a recessed surface of the base such that the end of the barb remains below or is flush with the distal side of mixing cup, for a more compact design.

In some embodiments, a second or vent pass-through (e.g., a second rigid structure) that provides a second, separate channel through the secondary chamber may be provided for venting the primary container. The second pass-through may connect another opening in the base of the mixing cup to a second opening in the lid, referred to here as primary vent opening, such that air may pass into the interstitial space between the two containers and consequently into the primary container to replace the volume of primary liquid drawn out of the primary container. Like the first pass-through, the second pass-through may be implemented by a rigid structure, optionally integrally formed with the main body, or by any suitable flexible structure, such as a tube. In some embodiments, the opening in the base of the mixing cup that connects to the second pass-through may be substantially flush with the bottom side of the mixing cup. In embodiments in which the second pass-through by a rigid structure extending through the secondary chamber toward the lid of the mixing cup, the second pass-through is arranged such that its outlet aligns with the primary vent opening in the lid. In some embodiments, the first pass-through is located substantially centrally in the secondary chamber while the second pass-through is located at the perimeter of the secondary chamber. In some embodiments, the lid further includes a second vent opening that provides a vent for the secondary chamber, also referred to as secondary vent. The secondary vent connects the interior of the secondary chamber to the exterior for venting the secondary chamber (e.g., for replacing the volume of dispensed secondary fluid with air from the ambiance).

The secondary liquid is drawn from the secondary chamber via a flexible tube positioned within the secondary chamber, which may also be referred to as secondary liquid pickup tube. The flexible tube may extend to the bottom interior wall of the secondary chamber. The flexible tube fluidly couples the secondary chamber to the secondary inlet of the mixing chamber and allows secondary fluid to be dispensed into the mixing chamber. The ratio of primary liquid to secondary liquid in the dispensed mixture, and thus the concentration of secondary liquid (e.g., flavoring) in the mixture, may be controlled in a variety of ways. In some embodiments, the ratio is controlled by the relative sizes of the apertures of the primary and secondary inlets into the mixing chamber and/or by the relative sizes of the primary and secondary liquid pickup tubes. In some embodiments, the ratio may be controlled by a flow control mechanism provided on the lid assembly. In some embodiments, the flow control mechanism includes an actuator, at least a portion of which is external to the secondary chamber and which is operable to control the amount of flow (e.g., a flow rate) of the primary liquid and/or the secondary liquid into the mixing chamber. In some embodiments, the flow control mechanism may include an actuator in the form of a sliding cover operatively associated with the primary vent and/or the secondary vent such that moving the cover relative to the primary vent and/or the secondary vent varies the size of the aperture of the respective vent thereby increasing or decreasing the flow rate or the respective liquid due to differences in the suction force needed to draw the respective liquid into the mixing chamber.

In some embodiments, the flow control mechanism is configured to vary the mixture ratio of the two liquids by restricting the flow of one or both of the liquids. In some embodiments, the restriction is performed by squeezing or clamping the secondary liquid pickup tube. In other embodiments, the flow control mechanism may be configured to squeeze or clamp the primary liquid pickup tube. In other embodiments, restricting the flow through one or both of the primary and secondary liquid pickup tubes may be accomplished by placing a needle valve, ball valve, or other type of valve in-line with the primary or secondary pickup tube. In some embodiments, the actuator interacts with a cam and follower mechanism (e.g., a cam and cam follower), which selectively restricts the flow through the secondary liquid pickup tube. In some embodiments, the flow control mechanism includes a clamp positioned within the secondary chamber to selectively, adjustably apply a clamping force to the secondary liquid pickup tube in response to manipulation (e.g., rotation) of the actuator.

In some embodiments, the actuator is rotated to vary the clamping force. For example, the actuator may be implemented by a knob rotatably mounted to the lid. In some embodiments, a cam of the cam and follower mechanism may be integral with the knob and may extend through to the opposite side of the lid and into the secondary chamber. As such, rotation of the knob causes synchronous rotation of the cam. The cam may have an irregular (i.e. non-circular) shape that interacts with a cam follower to cause the cam follower to slide relative to the lid based on the rotational position of the knob. The cam follower may be slidably supported inside the secondary chamber by first and second supports coupled to an underside of the lid. In some embodiments, the cam follower includes a first end operatively engaged with the cam and supported by the first support and a second end supported by the second support and which, in cooperation with the second support, applies the clamping force to the flexible secondary liquid pickup tube. In other embodiments, the actuator may be translated to vary the clamping force. For example, a sliding vent cover may be operatively coupled to a cam and follower mechanism to selectively vary a clamping force on the primary liquid pick up tube in addition to or alternatively to controlling the flow rate by variably occluding the vent opening(s). In some embodiments, the secondary vent may be selectively opened and closed as a result of manipulation of the actuator. For example, the first end of the cam follower near the cam may also apply a clamping force to a flexible tubular extension of the secondary vent as the knob is rotated to selectively restrict the flow of air through the secondary vent. The cam follower may be configured such that the clamping forces applied to the primary liquid pickup tube and the flexible tubular extension are synchronized (i.e., a similar amount of restriction down to complete constriction of the respective tubes is applied at the same time to each of the tubes).

The liquid mixture dispensing system according to the present disclosure may provide advantages over existing systems. For example, embodiments of the liquid mixture dispensing system are designed for externally coupling to existing primary liquid container (e.g., conventional soda can or bottle) without requiring a specialized primary liquid container and/or affecting the primary liquid container's ability to contain the primary liquid in the absence of the additive container. Another consideration in the design of a beverage mixing system is that the flavor and other characteristics of some mixed beverages begin to degrade at the time the components are mixed. By holding the primary and secondary liquids in separation until they are mixed at the time of dispensing, embodiments of the present disclosure may avoid degradation in the flavor or other characteristics or other adverse effects of prematurely mixing the liquids.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
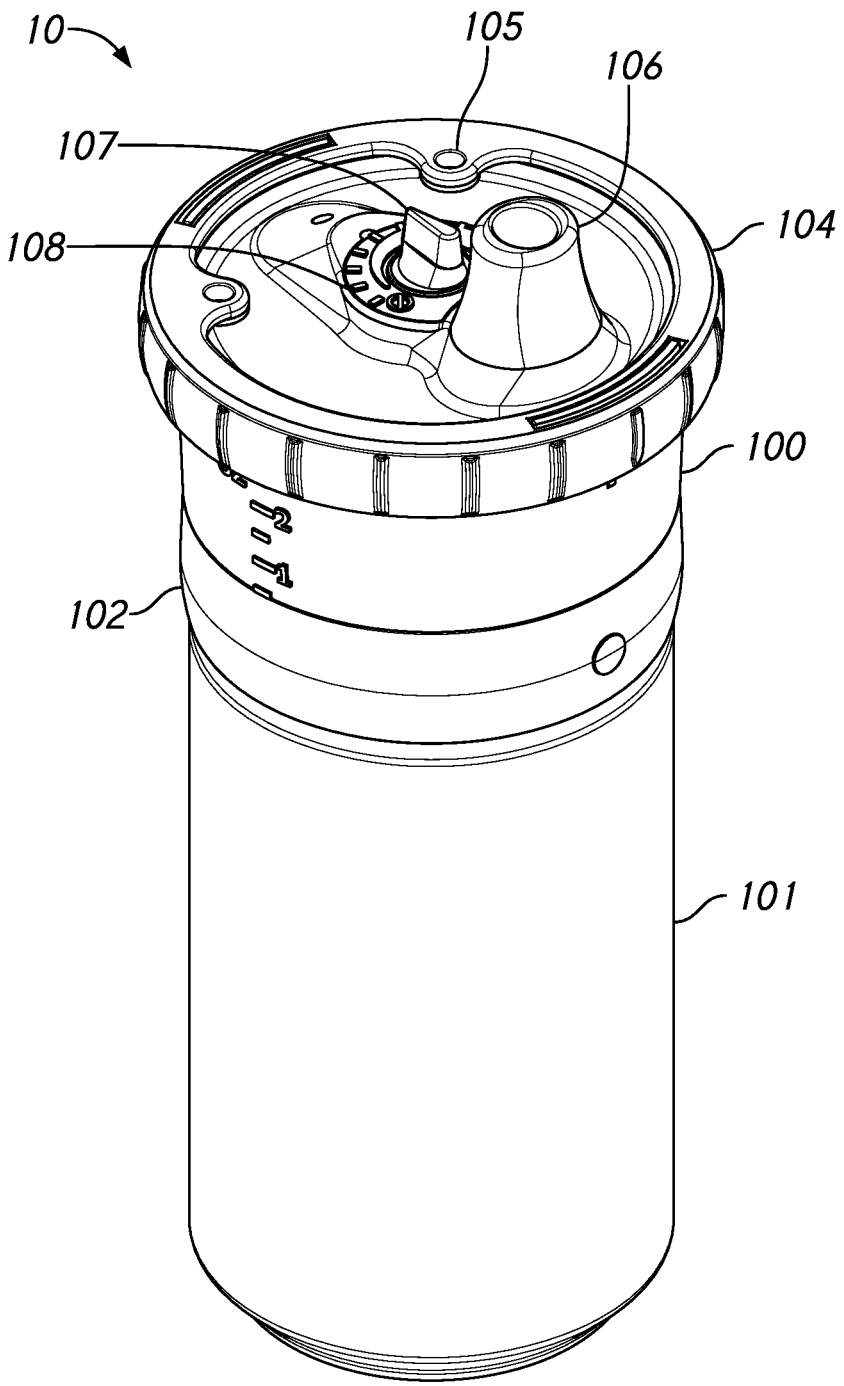
FIG. 1 is a perspective view of a secondary container according to some embodiments of the present disclosure, shown attached to an example primary container to form a multi-compartment container.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The following description of certain embodiments is merely exemplary in nature and is in no way intended to limit the scope of the disclosure or its applications or uses. In the following detailed description of embodiments of the present systems and methods, reference is made to the accompanying drawings which form a part hereof, and which are shown by way of illustration specific embodiments in which the described systems and methods may be practiced. These embodiments are described in sufficient detail to enable those skilled in the art to practice presently disclosed systems and methods, and it is to be understood that other embodiments may be utilized and that structural and logical changes may be made without departing from the spirit and scope of the disclosure. Moreover, for the purpose of clarity, detailed descriptions of certain features will not be discussed when they would be apparent to those with skill in the art so as not to obscure the description of embodiments of the disclosure. The following detailed description is therefore not to be taken in a limiting sense, and the scope of the disclosure is defined only by the appended claims.

As previously noted, it is sometimes desirable to create a mixed beverage by combining a primary liquid (also referred to as primary beverage or simply beverage) such as juice, soda, or water, with a secondary liquid (also referred to as liquid additive or simply additive) such as liquid flavoring, medicine or alcohol. In accordance with embodiments of the present disclosure, a liquid mixture dispensing system (e.g., mixing cup) is described which allows a primary liquid to be dispensed from its original container while it is being mixed with a secondary liquid during the dispensing.

FIGS. 1-8, show views of an example multi-compartment container 10 according to some embodiments of the present disclosure. FIG. 1 shows a secondary container (or mixing cup) 100 according to some embodiments of the present disclosure attached to a primary container 101 to form the multi-compartment container 10. The secondary container 100 is configured to be attached externally to a primary fluid container 101 using a coupling interface 102, examples of which will be described further below. In the present example, the primary container 101 is standard beverage can and the coupling interface 102 is configured for attaching the secondary container 100 to a standard beverage can. In other examples, the secondary container 100 may be configured to attach to another primary container, such as a glass or plastic bottle, a tumbler, a mug, or a jar. Many containers exist that have known or standardized geometries and dimensions, such as the standard beverage cans, mason jars, etc. Some standardized containers, while varying in capacity (e.g., fluid volume) have known and often generally the same top side configurations of the container (e.g., size and location of pull-tabs, stay tabs or push tabs, and lip size and its geometry, size of opening and threads in the case of bottles and standard mason jars) irrespective of internal volume. As such an external coupling interface, in some cases a kit of different coupling interfaces removably attachable to the secondary container, may be provided for coupling the secondary container to a variety of primary containers.

The secondary container 100 includes a main body 103, also referred to as secondary container body, and a lid assembly (or simply lid) 104. The main body 103 is implemented as a substantially rigid cup-shaped body that defines a reservoir or chamber, referred to here as secondary chamber 142 (see FIG. 6) for containing the secondary liquid. The secondary container 100 may include one or more accessory attachment features 105, such as attachment holes, posts, hooks, or other suitable attachment features, for securing an accessory, e.g., a drink marker, a decoration, or other types of accessories, to the secondary container. The accessory attachment feature(s) 105 may be provided on the lid 104, as shown in the example in FIG. 1, or elsewhere on the secondary container 100 (e.g., on the main body). In some embodiments, the accessory attachment features 105 may be implemented as substantially cylindrical projections on a suitable surface of the secondary container (e.g., on an outer surface of the lid 104) configured to enable attaching decoration(s) or other accessories to the secondary container 100. In some embodiments, these cylindrical projections may be tapered providing projections having a generally conical (or frustoconical) tips. In use, liquid (e.g., a mixture of the primary and secondary liquids) is dispensed from a dispensing outlet of the secondary container 100, shown here as spout 106. The spout 106 may be part of the lid assembly remaining fixed at all times. For example, the spout 106 may be rigidly mounted to the lid 104, in some cases integrally formed (e.g., injection molded) with the lid 104, as in the example in FIG. 1. In other embodiments, the spout 106 may be movable, e.g., between a stowed position and a use position. In some embodiments, the spout 106 is configured to enable a drinking tube or straw made of a resilient material to be sealably fitted either inside the spout 106 or over the outer wall of the spout 106 thereby allowing a user to sip from the tube or straw rather than directly from the spout 106.

In some embodiments herein, the ratio of primary to secondary liquids dispensed is adjustable by manipulating an actuator (e.g., knob 107) of a flow control mechanism. In this example, the knob 107 is rotatably coupled to the lid 104 and turning the knob 107 adjusts the amount of secondary fluid dispense into the mixing chamber of the secondary container 100, as will be further described. The actuator, here knob 107, may be associated with an indicator, shown here as dial face 108, which indicates a position or setting of the actuator (e.g., knob 107), a ratio, concentration, or other metric indicative of the relative amounts of the primary and secondary liquids in the mixture that will be dispensed from the spout 106. In this example, the dial face 108 includes markings for a plurality of discrete rotational positions of knob between the minimum (e.g., 0 setting or position) and a maximum setting or position. The minimum setting may correspond to a rotational position of the knob that results in the minimum amount of secondary liquid being dispensed into the mixing chamber, which in some cases may be 0. That is, in some embodiments, the flow of secondary liquid into the mixing chamber may be substantially fully restricted thereby providing only primary liquid into the mixing chamber and out of the spout to the user. The maximum setting may correspond to the rotational position of the knob in which the flow of secondary fluid into the mixing chamber is substantially unrestricted and is dictated solely by the size of the aperture of the secondary inlet to the mixing chamber. In some embodiments, the discrete settings of the indicator (e.g., dial face 108) may correspond to discrete rotational positions of the knob 107, which may be urged to a discrete setting for example by an over-center mechanism or some other type of detent. In other embodiments, while discrete settings are shown on the indicator, the knob may be continuously adjustable to any rotational position between the minimum and maximum position including positions between the discrete settings. In some embodiments, the dial face 108 may be removable from the lid 104, such as to replace it with a different indicator or for replacement in the case of damage. For example, the dial face 108 may be may die cut, stamped, or otherwise cut from a thin sheet of material into the desired shape that can be slipped on and off the knob 107. In other embodiments, the dial face 108 is over molded, laminated, or otherwise permanently affixed to the lid 104.

Figure 3:
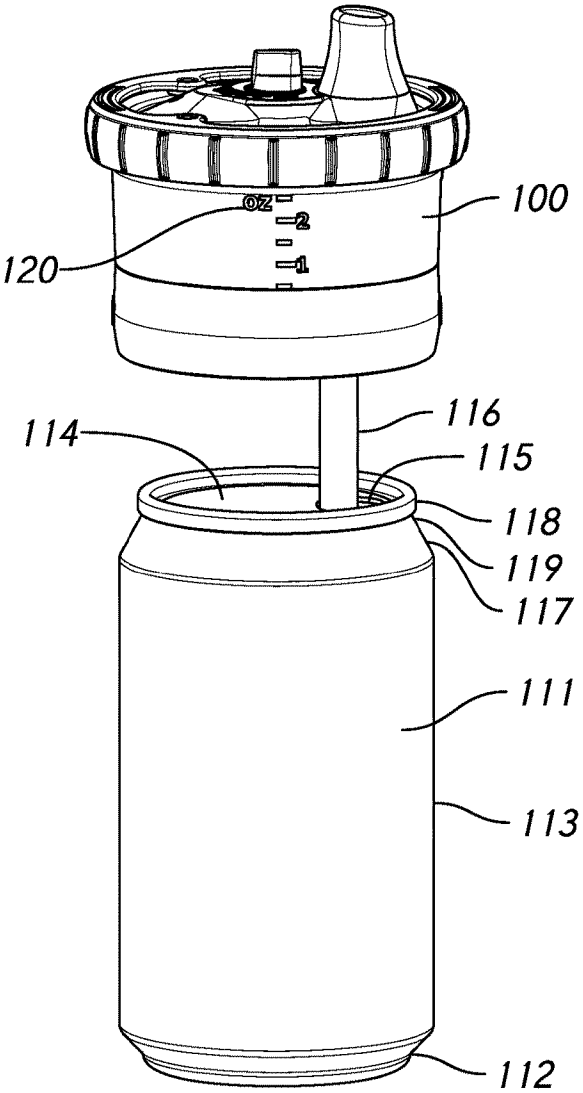
FIG. 3 is a side perspective view of the secondary container of FIG. 1 shown detached from the primary container.
Figure 2:
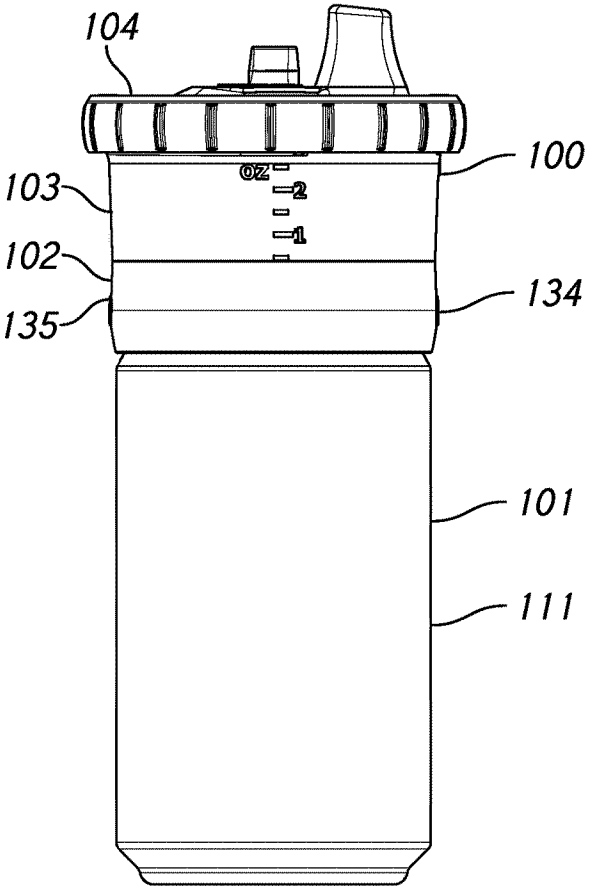
FIG. 2 is a side elevation view of the secondary container of FIG. 1 attached to a primary container as shown in FIG. 1.

FIGS. 2 and 3 show side elevation and side perspective view, respectively, of the multi-compartment container 10 with the secondary container 100 attached and detached, respectively, from the primary container 101. As previously noted the primary container 101 in this example is a standard aluminum beverage can 111. The beverage can 111 has a base 112, a substantially cylindrical sidewall 113, and a top surface 114. The top surface 114 defines a dispensing opening 115. When the beverage can 111 is sealed, a closure mechanism such as a pull tab, push tab or stay tab is provided across and sealing the dispensing opening 115. When the secondary container 100 is coupled to the primary container 101 (e.g., beverage can 111), a primary liquid pickup tube 116 extends into the primary container through the dispensing opening 115. An annular flange or lip 118 extends around the top of the primary container 101 (e.g., beverage can 111). At the top of the cylindrical sidewall 113 is region 117, which is radially-inwardly sloped and terminates at the annular lip 118. An annular recess 119 is formed where the annular lip 118 meets the sloped region 117 of the sidewall 113. The secondary container 100 is configured to externally couple to the primary container 101, in this case beverage can 111, via engagement with the lip 118 and recess 119. In other embodiments, the primary container may be a bottle, jar, mug, or other liquid container which may have similar geometry at the top side of the container (e.g., annular lip or thread and/or a recess or sloped region immediately below it). In some embodiments, instead of attaching the secondary container 100 to the lip 118 of beverage can 111, the secondary container 100 may attach to a thread of a mason jar or bottle, which may similarly have an inwardly sloped region at the top of its sidewall that terminates at a projecting feature, specifically a thread. In some embodiments, a coupling interface 102 of the secondary container may be configured to multi-purposefully attach to either a lip or a thread. In other embodiments, the coupling interface 102 may instead include thread(s) that cooperate with thread(s) on a bottle, jar, or other primary container 101. In some embodiments, the coupling interface 102 is removably attachable to the main body 103, for example using threads, a snap-fit attachment or other. This may enable one coupling interface (e.g., a coupling interface configured to attach to the primary container via snap-fit attachment) to be interchanged with another coupling interface configured for a different type of attachment to the primary container (e.g., a threaded attachment).

In some embodiments, at least a portion of the main body 103, such as the upper portion that defines the secondary chamber, may be formed of a sufficiently clear or see-through material. The clear or see-through material is sufficiently transparent or translucent to enable visualizing the level of the secondary liquid within the secondary chamber. In some embodiments, the body 103 may be formed (e.g., injection molded) from a plastic that has this see-through quality. The main body 103 may be provided with a liquid level indicator (e.g. graduated markings 120) on the outer wall of the see-through portion or on the interior but visible through the outer wall of the see-through portion, such that the graduated markings 120 can be used to determine the volume of liquid contained in the secondary container based on the level of the surface of the liquid also visible through the see-through portion. In some embodiments, substantially the whole rigid main body may be made (e.g., injection molded) from a see-through material, e.g., a plastic of sufficient transparency or translucency to enable a user to visualize the liquid level in relation to the liquid level indicator.

In some embodiments, the coupling interface 102 of the secondary container 100 may be implemented as an attachment ring 129 which may be provided at (e.g., fixed or removably coupled to) the bottom of the secondary container. The attachment ring 129 may include a flange projecting inward from the inner wall and designed to resiliently snap over and grab a flange or lip of the primary container 101. When so engaged, the secondary container 100 is securely attached to the primary container, in some cases sealing the interstitial space between a top enclosure or wall of the primary container 100 and the base of the secondary container 100. In some embodiments, the flange of the attachment ring may be cut away on two opposite sides such that in these cutaway regions the attachment ring does not contact the primary container. When the outer wall of the can attachment ring is urged inward near these cutaway regions the attachment ring temporarily deforms into an oblong shape to facilitate detaching the secondary container from the primary container. When the outer wall of the attachment ring is urged inward near these cutaway regions, the cutaway regions are brought closer together and the remaining regions of the flange are temporarily spaced farther apart (i.e., until the inward force is removed). Such deformation of the attachment ring decreases contact area between the flange of the attachment ring and the flange or lip of the primary container, thus decreasing the force required to separate the primary and secondary containers. As noted, in some embodiments, the primary container is a standard aluminum beverage can having a flange or lip extending around the top of the can. In some such embodiments the coupling interface of the secondary container may be implanted by an attachment ring as described and may be referred to as a can attachment ring.

Figure 4:
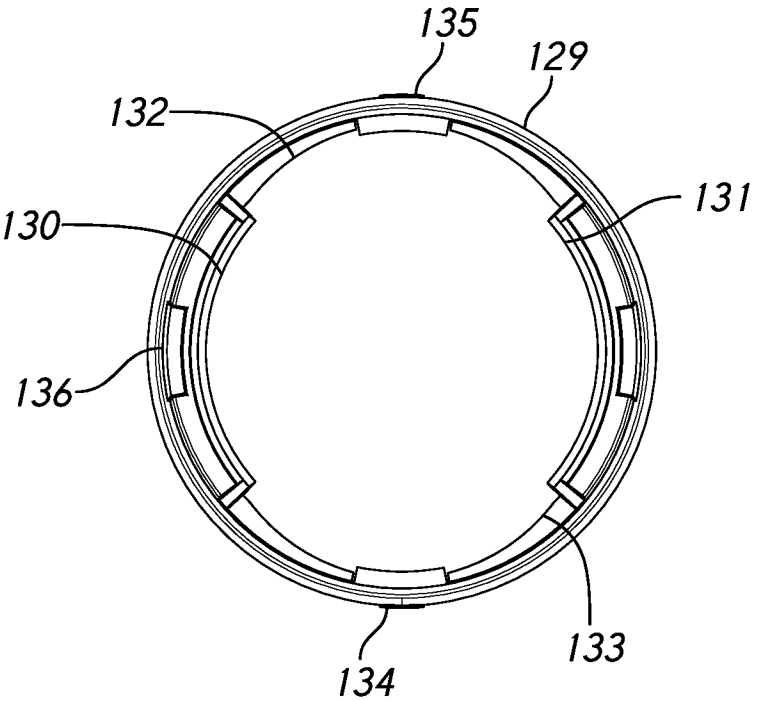
FIG. 4 is a bottom view of a coupling interface of the secondary container of FIG. 1.

FIG. 4 shows a bottom view of an example attachment ring 129 for attaching container 100 to a primary container 101 such as a beverage can 111. The attachment ring 129 may be molded into the base of the secondary container thus providing a non-removable coupling interface. Alternatively, the attachment ring 129 may be manufactured (e.g., molded, 3D printed) as a separate component from the main body 103 and attached (e.g., snap-fit, threaded or otherwise fastened) to the main body 103 of the secondary container 100. The outer wall 136 of the attachment ring 129 is made of thin resilient plastic or other resilient material. In the illustrated example, two semi-annular flanges 130, 131 project inward from the outer wall 136. Together, these flanges form the attachment flange of the attachment ring 129. The two flanges 130, 131 work together to attach the secondary container 100 to the primary container. In the illustrated example, two semi-annular cutout segments 132, 133 separate the two flanges 130, 131 along the perimeter of the attachment ring 129. The cutout segments 132, 133 may be formed by cutting or recessing the attachment flange at two radially opposite locations. These semi-annular cutouts provide two opposing regions of relatively lower stiffness as compared to the semi-annular regions that include the flanges 130, 131 allowing the attachment ring 129 to elongate in the direction between the two flanges 130, 131 increasing the distance between the two flanges 130, 131 when the outer wall 136 is urged inward at opposing locations 134, 135 along the outer wall 136. By temporarily deforming the attachment ring (e.g., elongating in the direction between the flanges 130, 131), the force required to snap the attachment ring 129 over the lip of the primary container 101 may be decreased, improving the ease of use of the secondary container 100.

In use, the primary container 101 and secondary container 100 are provided (or filled) with the primary and secondary liquids, respectively. This may occur before the given container is provided to an end user. For example, a beverage can 111 may be filled with a primary liquid (e.g., soda, juice or other non-alcoholic or alcoholic beverage) by a manufacturer and then sold to a consumer with the opening 115 sealed. The secondary container 100 may also be provided to the end user pre-filled, or optionally in the case of a secondary container with a removable lid 104, the secondary container 100 may be filled by the user. Prior to use, the opening 115 of the beverage can 111 is exposed/opened by the end user, the primary liquid pick up tube inserted through the opening 115, as shown in FIG. 3, and the secondary container 100 attached to the primary container 101 (e.g., beverage can 111) for use. The secondary container 100 may contain an additive liquid and the internal volume of the secondary container 100 may thus be smaller than that of the primary container 101 (e.g., beverage can 111). To form the multi-compartment container 10, the secondary container 100 is placed over the top of the primary container 101 (e.g., beverage can 111) such that the flanges 130,131 at the base of the secondary container 100 are positioned over the lip 118 of the primary container 101 (e.g., beverage can 111). The secondary container 100 is urged downward toward the primary container 101. The flanges 130,131 temporarily displace or flex outwardly as the secondary container 100 is pushed onto the primary container, the flanges then snapping back into place such that they engage the lip 118 and annular recess 119 (e.g., hooking under the lip 118) of the primary container. The secondary container 100 may thus attached to the primary container 101 (e.g., beverage can) via a snap-fit attachment mechanism for use. Removal of the secondary container may similarly be facilitated by the same resiliency of the attachment flange.

Figure 5:
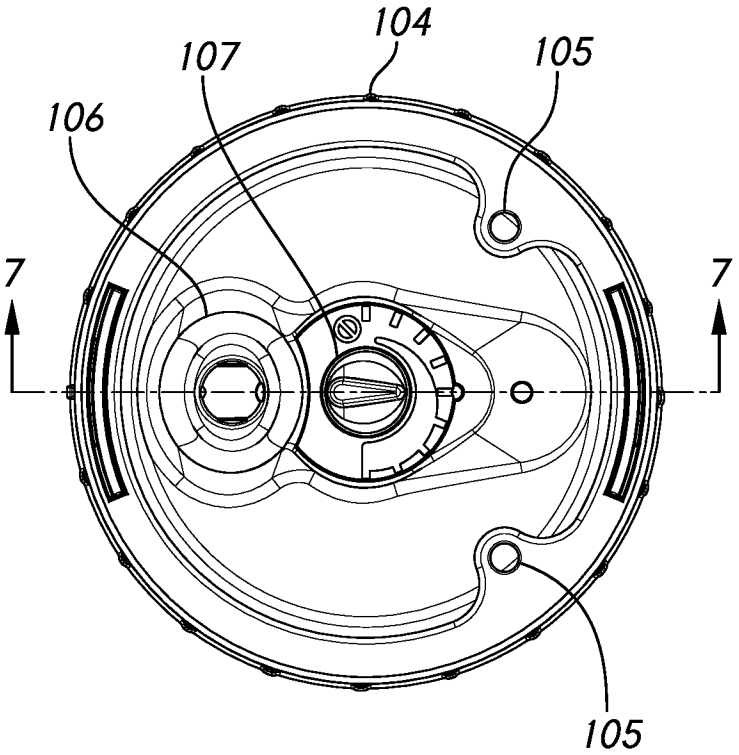
FIG. 5 is a top view of the secondary container of FIG. 1.

FIG. 5 shows a top view of the secondary container illustrating an exemplary arrangement of components on the lid 104. For example, the spout 106 may be located off-center such that it is generally aligned with the position of an opening 115 of a standard beverage can 111. As such a most direct passage may be provided for the primary liquid through the secondary container, from the opening 115 to the mixing chamber in the lid 104. In other embodiments, the spout may be positioned elsewhere. The knob 107 is adjacent to the spout 106 and is substantially centered on the lid 104, which may provide an aesthetically pleasing look. The one or more accessory attachment features 105 may be located near the periphery of the lid 104. In this example, two accessory attachment features 105 are provided at two spaced apart location proximate the lid periphery. A single accessory (e.g., a drink label, a name tag) may be positioned between the two accessory attachment features 105 and coupled/supported by both accessory attachment features 105, or each of the accessory attachment features 105 may be used to attach a different accessory.

Figure 6:
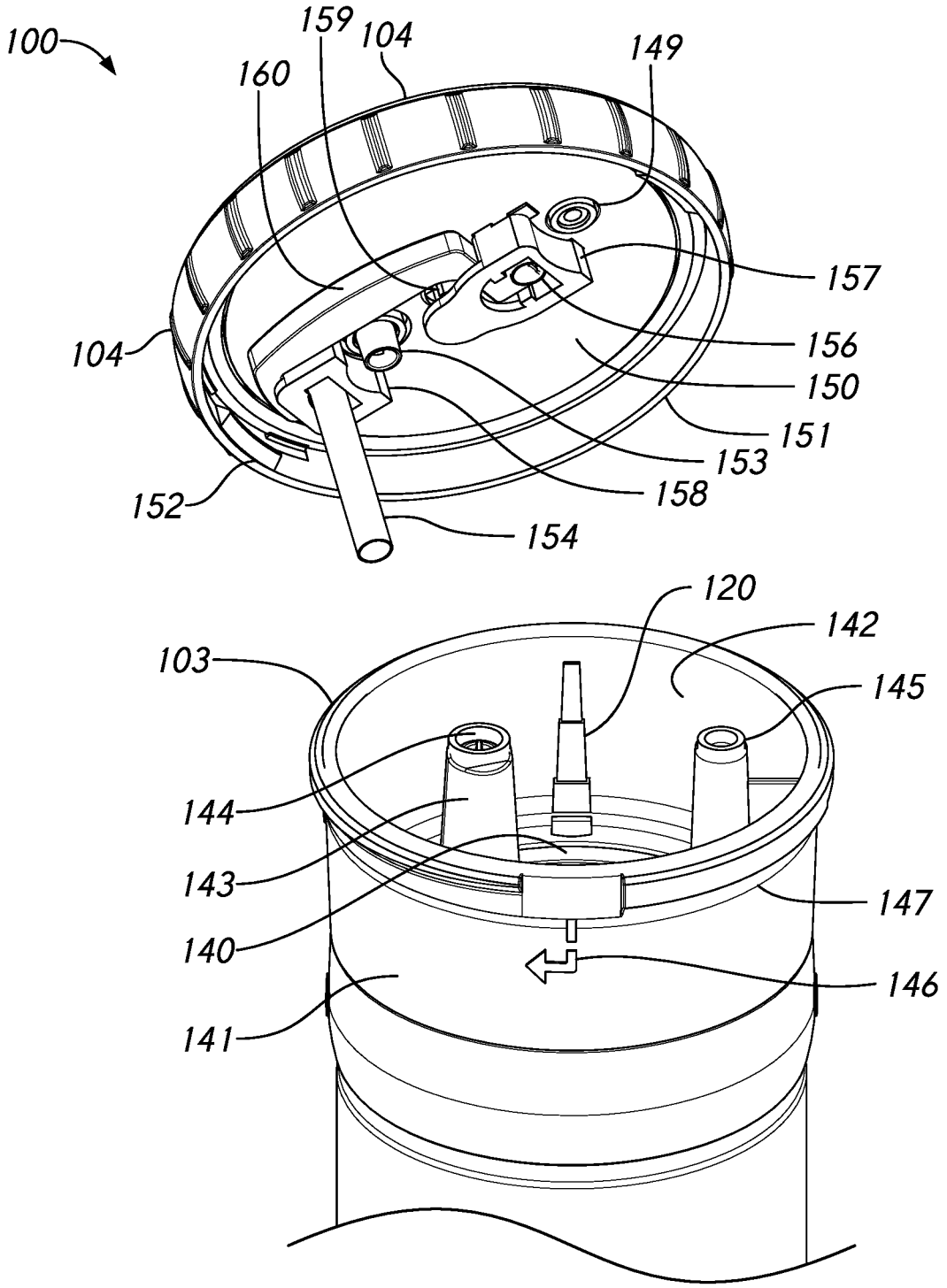
FIG. 6 is a perspective view of the secondary container of FIG. 1 with the lid separated from the main body of the secondary container.
Figure 7:
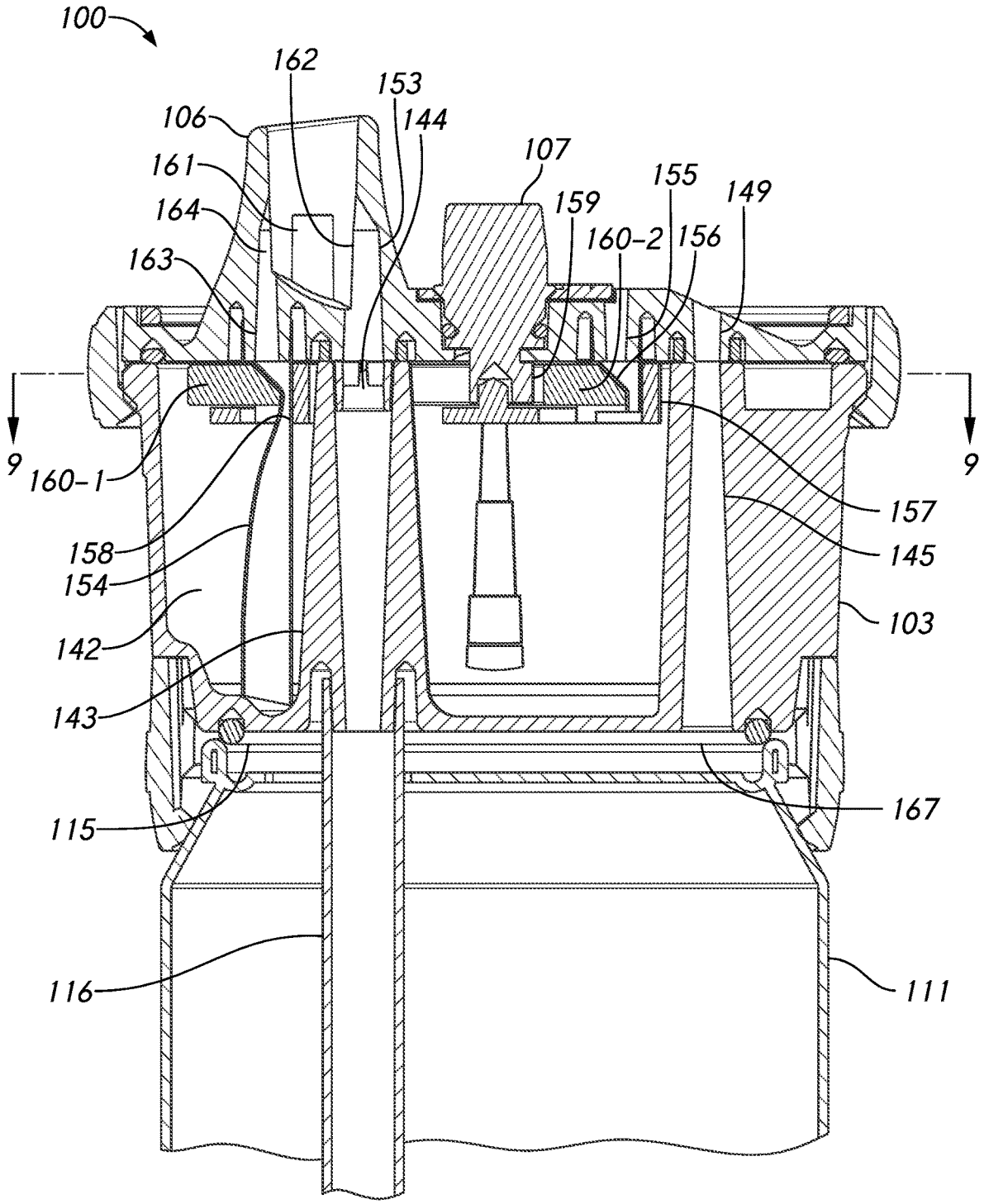
FIG. 7 is a section view of the secondary container of FIG. 1 taken at line 7-7 in FIG. 5.

FIG. 6 shows a partially exploded perspective view of the secondary container 100. The secondary container's lid 104 is shown removed from the secondary container's main body 103 and rotated slightly to show internal features of the secondary container 100 and the underside of the lid 104. FIG. 7 shows a cutaway view of the secondary container 100 attached to a primary container (e.g., beverage can 111), taken from plane 7-7 in FIG. 5. As shown in FIG. 6, the main body 103 includes a base 140 and sidewall 141 that together form the reservoir for the secondary liquid, referred to here as the secondary chamber 142. The secondary liquid may be any type of liquid such as a flavoring, alcohol, or other additive liquid desired to be mixed with the primary liquid. Referring also to FIG. 7, the secondary container 100 further includes a primary liquid pass-through 143 that provides a channel to conduct primary liquid from the bottom of the secondary container 100 (e.g., from and through the base 140 of the main body 103) to a primary liquid passage 144 in the lid 104. The primary liquid passage 144 fluidly connects the primary liquid pass-through 143 to the primary inlet 153 of the mixing chamber. An optional primary liquid screen 144 may be provided at an opening (e.g., base or top opening) of the primary liquid pass-through 143 or at the opening of the primary liquid passage 144 to prevent solids from being transmitted into and potentially clogging the primary liquid pass-through 143 and/or the primary liquid passage 153. The secondary container 100 may also include a primary container vent pass-through 145 for transmitting air between the optional primary container vent passage 149 in the lid 104 and the top of the primary container 101. Either or both of the pass-throughs 143 and 145 may be implemented as rigid structures, e.g., passages or channels that are integrally formed (e.g., molded) with the main body 103. A set of graduated markings 120 may be embossed, printed, or otherwise visible on the outer wall of the secondary container 100 to indicate the volume of secondary liquid contained in the secondary container 100 based on the level of the surface of the secondary liquid. In other embodiments, the mixing chamber and metering apparatus may be located in the base of the secondary container instead of the lid 104, and the primary liquid pass-through may communicate directly with a primary liquid aperture, eliminating the need for separate primary liquid pass-through 143 and secondary liquid pickup tube 154.

The lid 104 includes a substantially solid top 150 surrounded by a circumferential rim 151 extending downward from the top 150. The circumferential rim 151 includes threads 152 for securely attaching the lid 104 to the main body 103 of the secondary container 100. Corresponding threads 147 are provided on the sidewall 141 of the main body 103. When desired for use, the secondary container lid assembly 104 is positioned over the secondary container's main body 103 and turned such that the start of the threads 152 on the lid 104 are aligned with the start of the threads 147 of the main body 103. An alignment mark 146 may be provided on the main body 103 and a corresponding alignment mark on the lid 104 to indicate the proper orientation of the lid 104 relative to the main body 103 such that the threads 152, 147 on the lid and main body, respectively, can be engaged. Once the proper alignment is achieved, the lid 104 may be rotated (e.g., clockwise) while the main body 103 is held stationary to attach the lid thereto.

A flexible tube 154, which may be made of an elastomeric material such as silicone, projects downward from the lid 104 such that the bottom of the tube 154 is positioned near the base 140 of the main body 103 when the lid 104 is attached thereto. The flexible tube 154 fluidly connects the secondary chamber 142 to the mixing chamber in the lid 104 and may, thus, also be referred to as secondary liquid pickup tube 154. A secondary container vent tube 156, which may also be made from a flexible (e.g., elastomeric) material projects downward from the lid 104 into the secondary chamber 140. The secondary container vent tube 156 is connected to the lid 104, e.g., via a barb or other suitable structure to fluidly connect the secondary chamber 142 to the exterior of the secondary container 100 for venting. In the present example, the secondary container vent tube 156 extends approximately to the bottom of a pinch stop 157, but in other examples, the secondary container vent tube 156 may extend further downward, beyond the pinch stop 157.

In use, a mixture of the primary and secondary liquids is dispensed as a result of a user sucking on the outlet (e.g., spout 106) of the secondary container 100. This causes primary liquid to be drawn from the base of the primary container, here beverage can 111, through the primary liquid pickup tube 116, through the primary liquid pass-through 143 of the secondary container's main body 103, through the primary liquid channel 153 of the lid 104, through the primary inlet 162, and into the mixing chamber 161. Simultaneously, this causes secondary liquid to be drawn from the base of the secondary container 100, through the secondary liquid pickup tube 154, through the secondary liquid channel 163 of the lid 104, through the secondary inlet 164, and into the mixing chamber 161. The primary liquid and secondary liquid are thus entrained and mixed in the mixing chamber 161 and are drawn, as a mixture, out of the spout 106. As liquid is drawn out of the secondary container 100, air is drawn through the secondary container vent channel 155 in the lid 104, through the secondary container vent tube 156, and into the secondary chamber 142. If an optional primary container vent is present, when liquid is drawn from the primary container (e.g., beverage can 111), air is drawn through the vent passage 149, through the primary container vent pass-through 145 of the secondary container 100, into the interstitial space 167 between the primary and secondary containers, and into the primary container (e.g., beverage can 111) through the opening 115 thereof, around the perimeter of the primary liquid pickup tube 116.

For ease of manufacturing, such as to enable injection molding without requiring complex molds and/or secondary processes, one or more of the passages in the lid 104 (e.g., the primary and secondary liquid channels 153 and 163, respectively), may be formed as substantially vertically oriented, straight channels in the lid 104, which can be achieved via an injection molding process without requiring any special actions or complicated tooling. The drafts of the various components, including the vertical passages, are suitably selected to enable removal from a mold, again obviating the need for additional processes, such as the addition of cutting/drilling steps to form the various passages. Orienting the passages substantially vertically and/or configuring them as substantially straight passages, may additionally facilitate cleaning because a small brush or pipe cleaner can be pushed through said apertures and channels with minimal bending. The orientation of the apertures and channels in this example may also facilitate liquid (e.g., soapy water) to be easily flushed through the apertures and channels when the device is cleaned in a dishwasher. Of course, it is also envisioned that in some examples, the passages may be differently oriented, such as at an angle to the top and undersides of the lid and/or forming non-straight paths there through. Manufacturing of such embodiments may be achieved through the use of more complex tooling and/or 3D printing techniques.

A flow control mechanism of a beverage mixing container according to the present disclosure may include a first portion that positioned to remain substantially fixed to the lid (e.g., on the underside of the lid) and a second portion that is movably coupled to the lid and/or to the first portion. The second portion of the flow control mechanism is operatively associated with an actuator arranged for convenient access to the user, e.g., on the top side of the lid. The operation of the actuator (e.g., knob) results in movement of the second portion, which in turn results in the increase or decrease of the clamping force on the secondary liquid pick up tube 154 and, optionally, on the vent tube 156. The first (or fixed) portion of the flow control mechanism may, in some embodiments, support the second portion (e.g., substantially restricting one or more degrees of freedom of the second portion). In some cases, the first (or fixed) portion is implemented by a plurality of separate components, each of which may support a different portion or end of the second (movable) portion of the flow control mechanism. An example of a flow control mechanism is described in further details with reference again to FIGS. 6 and 7, and also with reference to FIG. 8, which shows an exploded perspective view of the secondary container 100. A cam follower 160 is slidably disposed below the lid 104 (e.g., to the underside of top 150). In use, the knob 107 and consequently cam 159 are rotated, causing the cam follower 160 to translate (i.e. slide) below the lid top 150. In some embodiments, the cam follower 160 may slide in contact with the underside of the lid top 150 or it may be spaced apart from the underside of the lid top by a small gap and translate in this spaced apart arrangement relative to the lid top 150 between the open and closed positions and any incremental position therebetween. As the cam follower 160 translates (i.e., slides), it simultaneously compress the secondary liquid pickup tube 154 and optionally the secondary container vent tube 156 against the pinch stops 158 and 157, respectively. When the secondary liquid pickup tube 154 and secondary container vent tube 156 are compressed, the flow of secondary liquid is restricted, thus reducing or eliminating any flow of secondary liquid into the mixing chamber 161. At the same time, if the secondary container vent tube 156 is also compressed, air flow into the secondary container is restricted or prevented depending on the amount of clamping force applied. The terms compressed, pinched, squeezed, clamped or restricted may be used interchangeably when referring to the application of clamping or squeezing force to a flexible tube (e.g., the secondary liquid pickup tube 154 or the secondary container vent tube 156). In this embodiment, the cam follower 160 is movably (e.g., slidably) secured to the lid top 150 by the pinch stops 157 and 158, which thus also act as supports for the cam follower as well as components that cooperate with the cam follower to apply the clamping force to the flexible tube(s), thereby reducing the total number of components of the lid assembly 104. In other embodiments, the cam follower 160 may be disposed in a support channel or supported by a dedicated support structure. In some examples, the pinch stops 157 and 158 may be integrated into a one-piece structure, as will be described future with reference to FIGS. 9D-9F.

When the knob 107 is in the fully open position, the ratio of secondary liquid to primary liquid in the final dispensed mixture is primarily controlled by the ratio of cross sectional area of the secondary liquid aperture to the cross sectional area of the primary liquid aperture. It is also affected to a lesser degree by any other flow restrictions present in the various tubes and passages. When the knob 107 is rotated to a position other than fully open, the cam 159 urges the opposite ends 160-1 and 160-2 of the cam follower 160 toward their respective pinch stop, thereby applying a clamping force to the respective one of the tubes 154 and 156. One end 160-1 of the cam follower 160 applies a pinching or clamping force to the flexible tube 154 by compressing the flexible tube 154 against the pinch stop 158 thereby restricting the flow of secondary liquid through the tube 154. At the same time, the other end 160-2 of the cam follower 160 applies a pinching or clamping force to the secondary container vent tube 156 by compressing the tube 156 against the pinch stop 157 thereby restricting the flow of air through the secondary container vent tube 156. The resulting restrictions in the secondary liquid pickup tube 154 and secondary container vent tube 156 decrease the rate of flow of secondary liquid into the mixing chamber, and thereby decreasing the ratio of secondary liquid to primary liquid in the dispensed mixture. When the knob 107 is rotated to the fully closed position, the secondary liquid pickup tube 154 and secondary container vent tube 156 are completely obstructed, which seals the secondary chamber to prevent leakage of secondary liquid out of the secondary chamber.

As previously described, the main body 103 of the secondary container 100 forms a reservoir or chamber 142 for containing a secondary liquid. The main body 103 in this example is substantially cylindrical and has a closed bottom, however the main body 103 can have virtually any other shape capable of containing a liquid. In this example, the coupling interface 102 is implemented as an attachment ring 129 that attaches to the bottom of the main body 103 by a snap-fit mechanism. However, in other examples, the attachment ring 129 may be attached via threads or may be integral with the main body 103. An o-ring or gasket 180 made of an elastomeric material such as silicone is fitted to or molded over the base of the secondary container. The gasket 180 may be provided within a ridge on the bottom side of the main body 103. The gasket 180 provides a seal between the top of the primary container (e.g., the top surface 114 or lip 118 of the beverage can 111) and the bottom of the secondary container 100 to prevent leakage. In some embodiments, the primary liquid pickup tube 116 is made of a flexible and resilient material. It is attached to the base of the secondary container 100 by stretching over a substantially toroidal barb 181 formed into the base of the secondary container 100 (e.g., on the bottom side of the main body 103). A central passage through the barb 181 forms the base of the primary liquid pass-through 143 of the secondary container 100. In other embodiments, the primary liquid pickup tube may be rigid and/or integral to the primary container 101 or the secondary container 100.

The lid assembly 104 includes a lid top 150 and an outer attachment ring 173 that defines the rim 151 (see FIG. 6). When assembled into the lid assembly 104, the outer attachment ring 173 surrounds the lid top 150. An annular ridge 174 projects inward from the top edge of the outer attachment ring 173 such that when assembled, the annular ridge 174 exerts downward pressure on the lid top 150. A snap-fit mechanism 175 retains the lid top 150 to the outer attachment ring 173 through snap-fit engagement of a plurality of semi-annular ridges 176 projecting upward from the outer edge of the lid top 150. When the lid assembly 104 is assembled, the semi-annular ridges 176 project into or through corresponding cutouts in the annular ridge 174 of the outer attachment ring 173, preventing rotation of the lid top 150 relative to the outer attachment ring 173. In other embodiments, the lid top 150 and outer attachment ring 173 could be bonded via adhesive, ultrasonic welding, or other suitable attachment method. A separately formed lid top 150 and outer attachment ring 173 may be advantageous in some cases from a manufacturing standpoint, for example to minimize undercut regions during injection molding. However, it is also envisioned that some embodiment, the outer attachment ring 173 may be integrally formed with the lid top 150. The lid top 150 and outer attachment ring 173 may be integrally formed by any suitable manufacturing technique, for example, by molding (e.g., injection molding of a plastic material), laminating, machining (e.g., removing material form a block of plastic, metal, or composite material), 3D printing or other currently known or later developed processes.

The inner surface of the outer attachment ring 173 incorporates threads 152 designed to engage with threads 147 on the main body 103. In some embodiments, a seal between the lid 104 and the main body 103 may be formed, when the two are attached to one another, by an o-ring or gasket 177. The gasket 177 may be provided at any suitable location on the lid 104, such as along the periphery of the lid top 150, the gasket 177 positioned to engage the rim of the main body 103. The gasket 177 may be made of an elastomeric material. The gasket 177 may be fitted in an annular groove formed in the lid 104. In other embodiments, a gasket may be overmolded or bonded to the lid 104 or to the main body 103. In yet other embodiments, an annular ring could project downward from the outer edge of the lid 104 which may be configured to fit tightly against the inner wall of the main body 103, thus sealing the lid 104 to the main body 103 without a gasket.

A seal between the primary liquid pass-through 143 and the lid 104 may be formed by a gasket 178, which may be made of an elastomeric material. A seal between the primary container vent pass-through 145 and the lid 104 may similarly be formed by a gasket 179, which may similarly be made of an elastomeric material. In some embodiments, one or both of the gaskets 178 and 179 are implemented by short lengths of silicone tubing or tubing of other suitable material. Using a short length of tubing rather than an o-ring for the gaskets 178, 179 may reduce the risk of the gaskets inadvertently dislodging during the assembly of the lid 104 to the main body 103. In embodiments in which the lid 104 is secured to the main body 103 by engagement of threads, the lid 104 is rotated relative to the main body 103 to cause the threads to engage and urge the lid 104 toward the body 105. This rotating motion of the lid 104 may result in the gaskets 178 and 179 to slide along the top of the respective one of the primary liquid pass-through 143 and the primary container vent pass-through 145 as the lid 104 is threaded to the main body 103. This sliding motion may cause certain types of gaskets, such as o-rings or substantially sheet-thin gaskets, to roll or become dislodged as the lid 104 is secured to the body 105. Using a short length of tubing (e.g., silicone tubing) for the gaskets 178, 179 may reduce the risk of accidental dislodgement of the gaskets 178, 179. The gaskets 178, 179 may alternatively or additionally be bonded or implemented as overmolded gaskets. In other embodiments, an o-ring or thin (e.g., washer-type) gasket may be used, optionally with bonding or otherwise securing the gaskets 178, 179 at their respective locations on the underside of the lid or to the top of the respective pass-through.

A flexible tube 154, which may be made of an elastomeric material, is stretched over a barb at the base of the secondary liquid passage 163. A secondary container vent tube 156, which may similarly be made of an elastomeric material, is stretched over a barb at the base of the secondary container vent passage 155. As previously described a cam follower 160 is disposed near the bottom of the lid top 150 and movably held in place by a suitable support structure, in this case by the pinch stops 157 and 158. The pinch stops 157, 158 may be operatively coupled to the lid 104 (e.g., bonded or press-fit to the underside of the into the lid top 150). In other embodiments, the pinch stops may be integral to the lid 104. The cam follower 160 is operatively engaged with the pinch stops 157, 158. In this example, the pinch stops 157 and 158 remain stationary when the flow control mechanism is actuated to adjust the flow of secondary liquid, while the cam follower moves (e.g., slides or translates relative to the pinch stops and the rest of the lid assembly 104). The configuration described herein enables provide a means to restrict the secondary liquid pickup tube and the secondary container vent tube at the same time, by the opposite sides of the cam follower simultaneously pinching or clamping the respective tube. An optional screen 144 may be inserted into or integrally formed with primary liquid pass-through 143.

Figure 8:
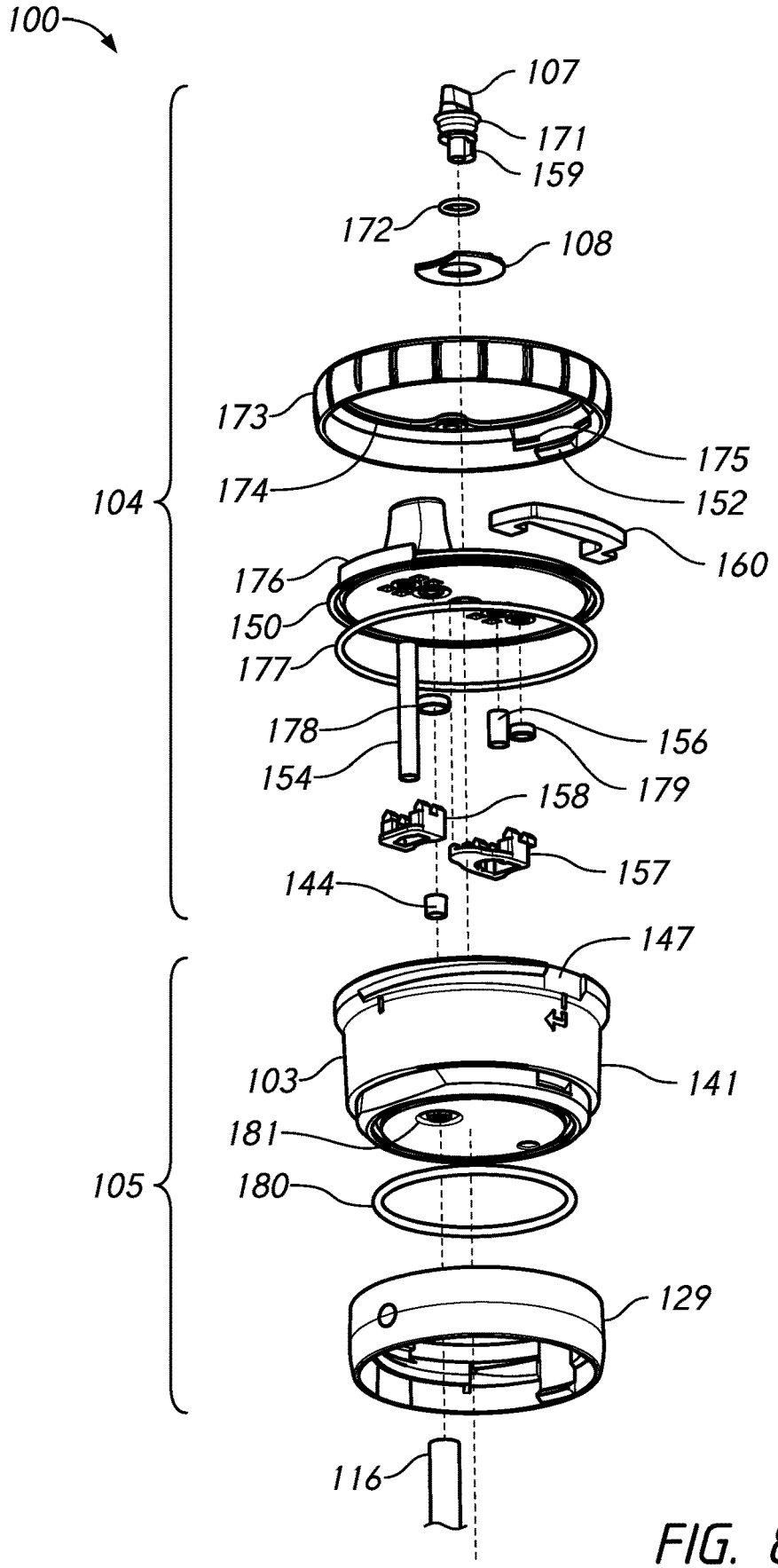
FIG. 8 is an exploded view of the secondary container of FIG. 1.

In the embodiment in FIG. 8, the cam 159 is integral with the knob 107. The cam 159 may be integrally formed at the base of the knob 159, such as through injection molding, machining, or 3D printing. The cam 159 may be inserted through a knob insertion hole in the lid top 150 such that the top of the cam 159 is just below the bottom of the lid top 150. The knob 107 may include a region of increased diameter 171 between the actuation end of the knob and the cam 159, sized larger than the knob insertion hole in the lid top 150 to retain the knob 107 against the lid top 150 preventing the knob 107 from passing through knob insertion hole. The knob insertion hole may have an eccentric profile that may correspond to the profile of the cam to allow for the insertion of the cam therethrough. The orientation of the eccentric profile of the knob insertion hole may be misaligned to any operational position of the cam such that once assembled, the cam is not intended to be rotated to a position of alignment with the eccentric profile of the knob insertion hole. This retains the knob in the knob insertion hole by preventing the knob from passing through the hole, by virtue of the region of increased diameter 171 and by preventing the cam from passing out of the hole by virtue of interference, due to misalignment between the profiles of the cam and knob insertion hole. An o-ring or other suitable gasket 172 may be fitted to the knob 107 to provide a liquid-tight seal between the knob 107 and the lid top 150. An optional metering dial face 108 may be provided, in some cases removably, to indicate a rotational position (e.g., setting) of the knob 107 and thereby the amount of secondary liquid that will be introduced into the dispensed mixture. In other embodiments, the cam 159 may be separable from the knob 107, for example by being threaded to the base of the knob which may extend to the underside of the lid 104, which may enable interchanging with a differently shaped cam or replacement in the case of damage.

Figures 9A, 9B, 9C:
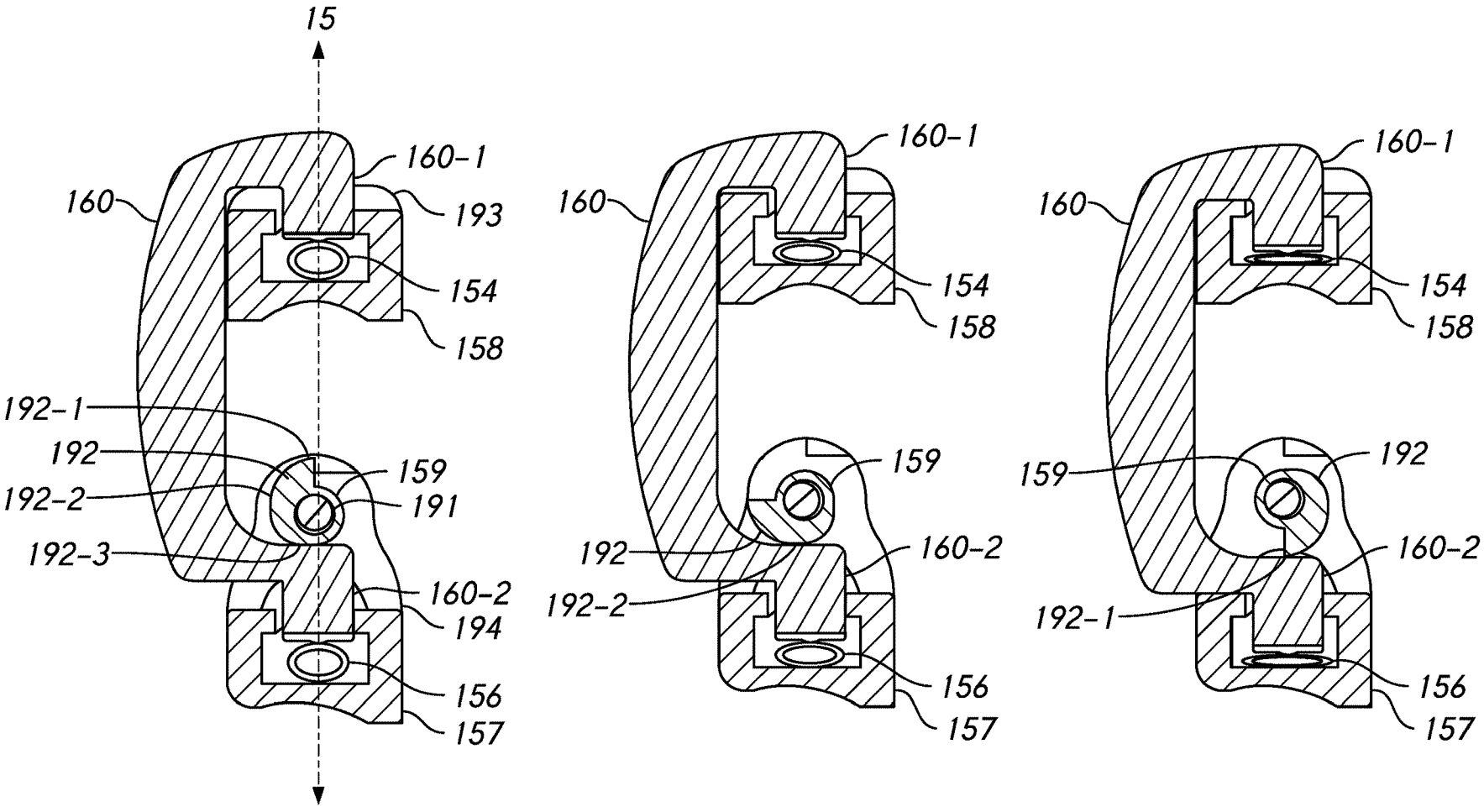
FIGS. 9A-9C are sectional views that show an example cam mechanism of a flow control mechanism of the secondary container of FIG. 1, shown in a first (substantially unrestricted) position (FIG. 9A), a second (substantially restricted) position thereof (FIG. 9C), and an intermediate position therebetween (FIG. 9B).

FIGS. 9A-9C are views illustrating a cam and follower mechanism that can be used to implement the flow control mechanism of a secondary container according to the present disclosure. FIG. 9A shows the cam 159 and follower 160 in a position in which the flexible tube(s) (e.g., secondary liquid pickup tube 154 and/or secondary container vent tube 156) are substantially unclamped or unrestricted. In FIG. 9B, the flow restrictor (e.g., cam 159 and follower 160) has been actuated to another position in which flow through the tube(s) (e.g., secondary liquid pickup tube 154, secondary container vent tube 156) is partially restricted. In FIG. 9C, the flow restrictor (e.g., cam 159 and follower 160) has been actuated to a further position in which flow through the tube(s) (e.g., secondary liquid pickup tube 154, secondary container vent tube 156) is substantially fully restricted.

The cam 159 is rotatably supported, via its center portion or shaft 191, on the underside of the lid 104, with the cam surface 191 positioned within the secondary chamber 142. As described above, the cam 159 may be integrated with the actuator (e.g., knob 107) of the flow control mechanism, or it may be otherwise operatively associated therewith (e.g., be fixed to opposite ends of a common shaft) to rotate as a result of rotation of the knob. The cam 159 includes has a surface, referred to here as cam surface 191, which has an eccentric (i.e., non-circular) profile defining a plurality of radial locations (e.g., locations 191-1, 191-2, 191-3) differently spaced from the center of the cam's shaft 191. As such, the cam surface 192 includes at least one radial location 192-1 which is located farther from the center of the cam than at least one other radial location (e.g., locations 192-2, 192-3). The distance from the center to each radial location varies gradually in this example to provide for gradual adjustments of the flow. In other examples, a different cam surface profile may be used to provide a different adjustment profile.

The follower 160 is provided in contact with the cam 159 and is slidably supported on the underside of the lid 104 by one or more follower supports. In this example, the follower 160 is supported by a pair of follower supports including a first support 193 which supports one end 160-1 of the follower and a second support 194 that supports the other end 160-2 of the follower 160. The supports 193 and 194 slidably support the follower 160 such that its movement is substantially constrained to translation along the direction 15 defined between its end 160-1 and 160-2. The term slidably as used herein does not necessarily imply that the follower slides on, or is in contact at one or all times with, the underside of the lid, but is used herein to imply a substantially translational rather than rotational motion. The cam 159 may also be supported by one of the supports. For example, the end of the cam 159 farthest from the underside of the lid may be supported by the support 194 to stabilize the cam 159 as it is rotated between settings. The supports 193 and 194 may incorporate the pinch stops 158 and 157, respectively, or the pinch stops may be separate components operatively positioned to provide a fixed surface relative to which the clamping ends of the follower 160 move to apply the clamping force to the flexible tubes.

The follower 160 in this example is implemented by a substantially C-shaped rigid member having a first end 160-1 that engages (e.g., to pinch or clamp) the secondary liquid pickup tube 154 and a second end 160-2 that engages (e.g., to pinch or clamp) the secondary container vent tube 156. Each of the ends 160-1 and 160-2 of the cam follower includes a pinch side which applies the clamping or pinching force to the respective tube. The pinch sides of the follower 160 may be wedge shaped and oriented with their pointed end against the respective flexible tube to improve the cam follower's ability to pinch the flexible tube(s) closed. The pinch side of the first end 160-1 faces inward (towards the concave side of the C), while the pinch side of the second end 160-2 faces in the opposite direction or outward (away from the concave side of the C). The cam 159 is positioned to engage an inner side of the follower 160, in this case contacting and pushing against the side opposite the pinch sides of the second end 162-2 of the follower 160. The follower 160 (e.g., the end 160-2) may be biased into contact with the cam surface 192 by the resilience of the flexible tube 156 which tends to return to its nominal (e.g., circular) shape absent the application of external force. In use, as the user rotates the knob 107 from the nominal position shown in FIG. 9A toward a flow-restricting position (e.g., FIGS. 9B and 9C), the cam surface 192 rotates relative to the engagement surface of the cam follower 160, while remaining in sliding contact therewith. This causes the cam 159, by virtue of its eccentric cam surface, to push the engaged end of the follower 160, here end 160-2, away from the center of the cam 159, which is fixed relative to the lid, thereby causing the follower 160 to slide or translate relative to the lid 104 generally along direction 15. When the knob is rotated in the opposite direction to return the cam 159 from a flow-restricting position (e.g., FIG. 9C or 9B) towards the unrestricted position (FIG. 9A), the cam follower 160 returns to its nominal position in FIG. 9A under the biasing force that urges the follower 160 into contact with the cam 159. In some embodiments a further biasing mechanism (e.g., a spring) in addition to the flexible tube(s) may be used, particularly when the optional vent tube 154 is omitted.

Figure 9D:
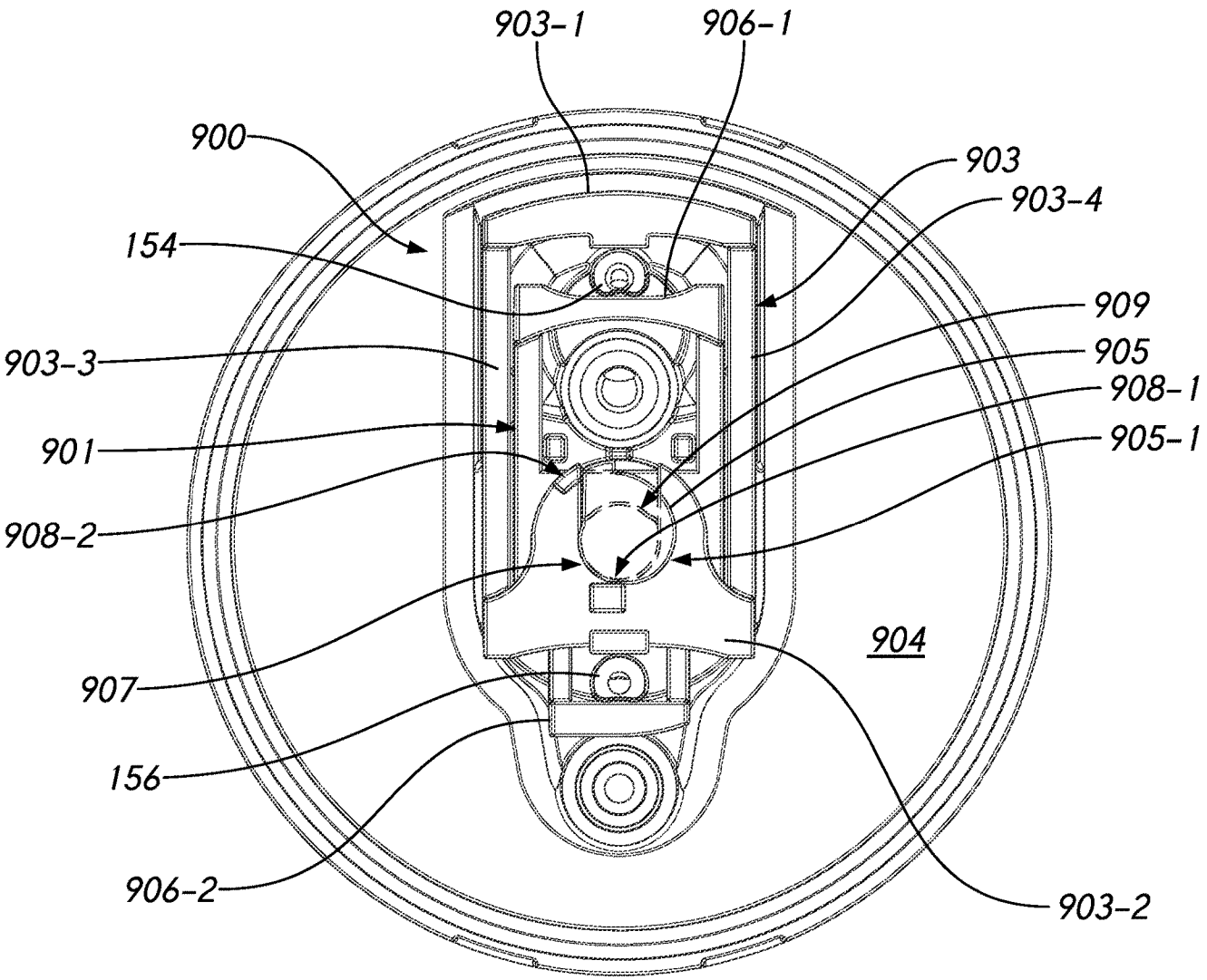
FIGS. 9D-9F are plan views of the underside of a lid for a secondary container, which show another example flow control mechanism, shown in a first (substantially unrestricted) position (FIG. 9D), a second (substantially restricted) position thereof (FIG. 9F), and an intermediate position therebetween (FIG. 9E).
Figure 9E:
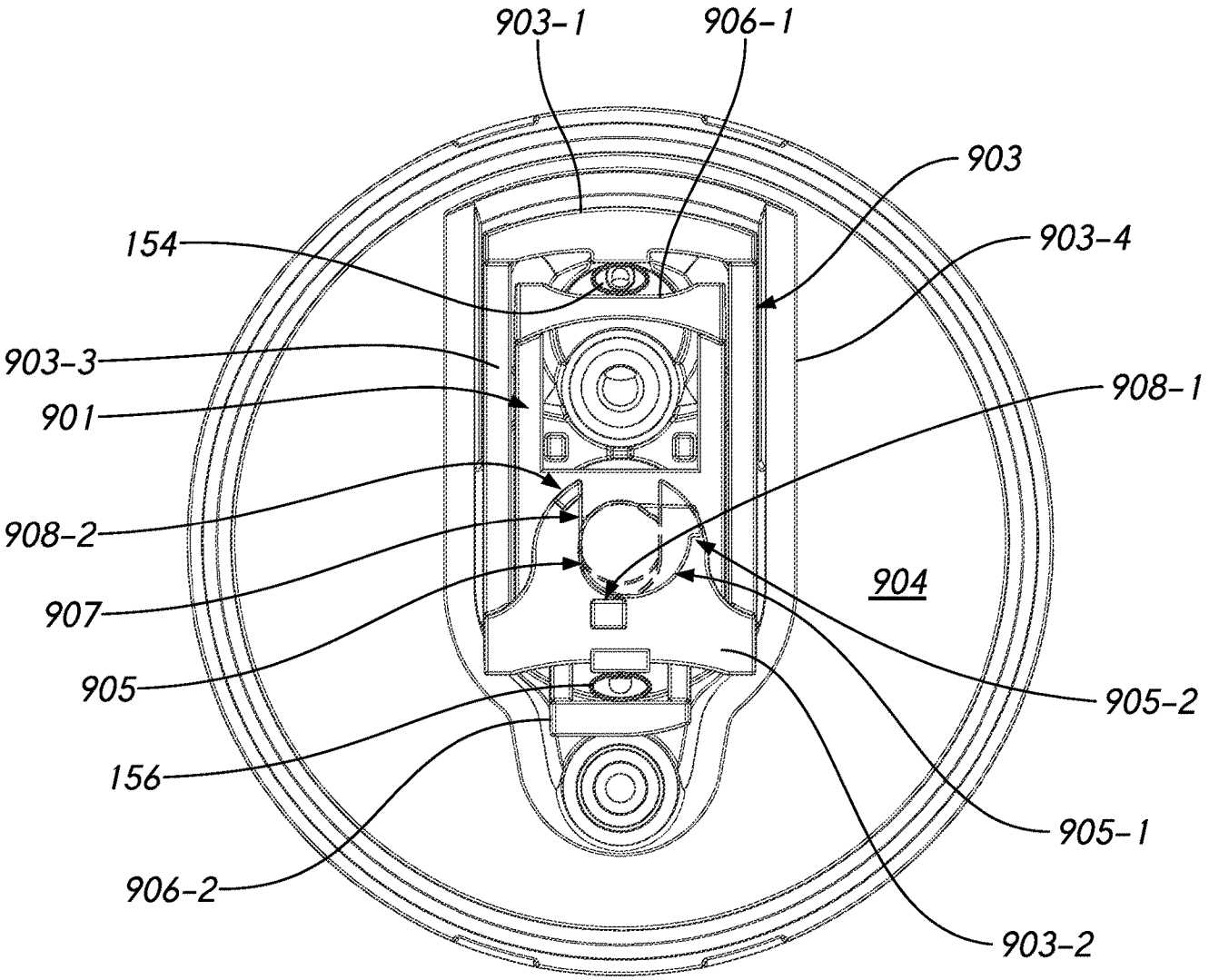
Figure 9F:
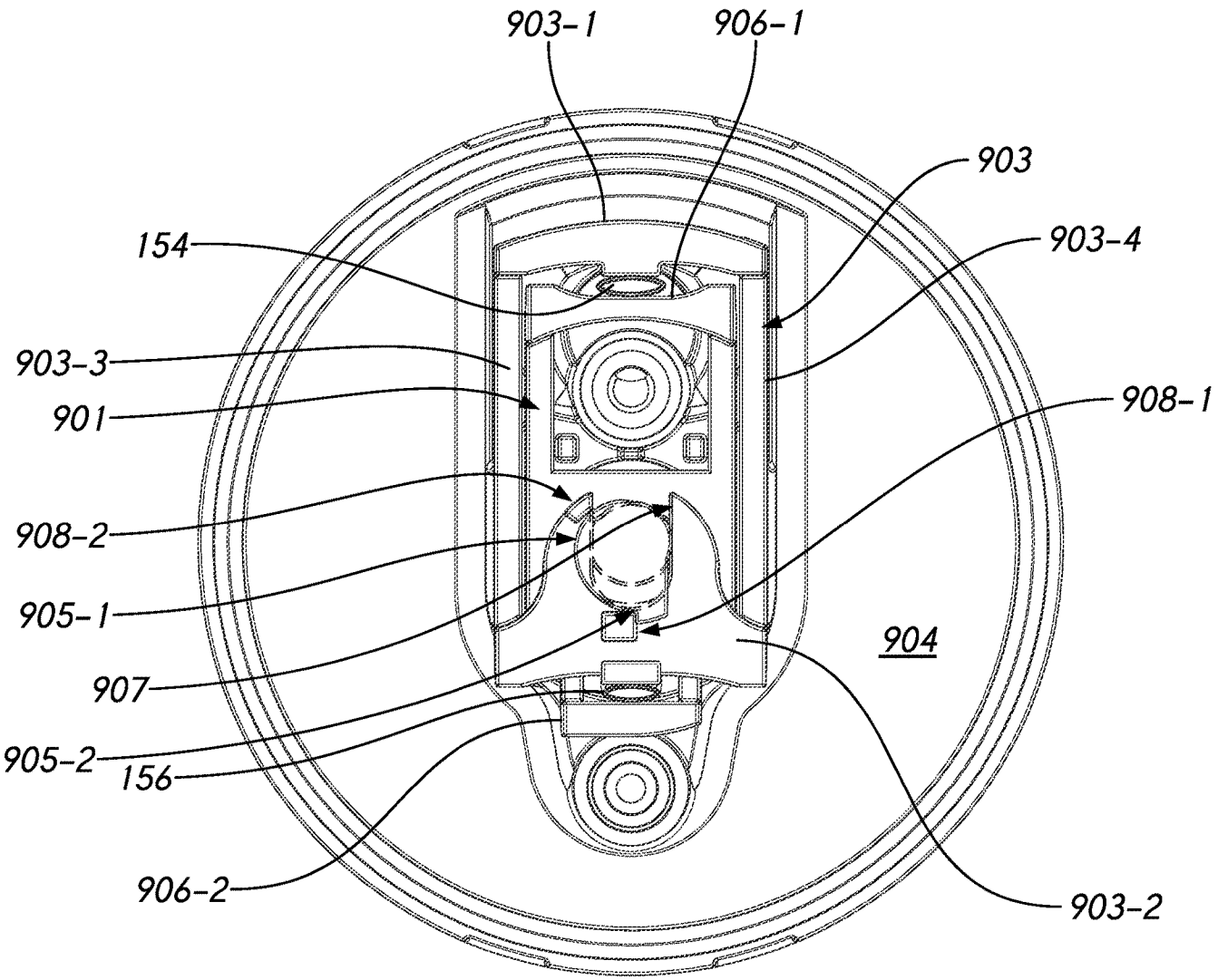

FIGS. 9D-9F show views of a flow control mechanism according to further examples of the present disclosure. The flow control mechanism 900 includes first (or fixed) portion 901, which is mounted so as to remain substantially fixed to the lid 904, and a second (or movable) portion 903 which is movable relative to the lid 904 and the fixed portion 901. The fixed portion 901 includes a first pinch stop 906-1 proximate the pickup tube 154 and optionally a second pinch stop 906-2 proximate the optional vent tube 156. The first and second pinch stops 906-1 and 906-2 may be connected, forming an integral structure, which is coupled to the underside of the lid 904.

The movable portion 903 includes a first clamping side 903-1 configured to move towards the first pinch stop 906-1 to selectively apply a clamping (or squeezing) force to the secondary liquid pick up tube 154. The movable portion 903 may optionally include a second clamping side 903-2 spaced from the first clamping side 903-1 and configured to move, concurrently with the first clamping side 903-1, toward the second pinch stop 906-2 to concurrently apply a clamping (or squeezing) force to the optional vent tube 156. In this example, the first and second clamping sides 903-1 and 903-2, respectively, are joined by first and second lateral sides 903-3 and 903-4 forming a generally rectangular integral frame. The movable portion 903 is operatively associated with an actuator, shown here as a cam 905 joined to a knob (e.g., knob 107 of FIG. 1), at least a portion of which is located externally, e.g., on the upper side of the lid 904. A slot 907 is defined in the frame to accommodate the axle 909 joining the cam 905 to the knob 107.

The movable portion 903 is configured to cooperate with the cam 905 such that rotation of the cam 905 in a first direction (as shown in the progression from FIG. 9D to FIG. 9F) causes the first and second clamping sides 903-1 and 903-2, respectively, to move toward respective one of the first pinch stop 906-1 and the second pinch stop 906-2, thus squeezing the respective tube. This movable portion 903 may be configured in various ways for operative engagement with cam 905. In the illustrated example, the movable portion 903 includes a nub 908-1 projecting from its lower surface and the cam surface 905-1 slidably engages the nub 908-1 to move the portion 903, as the cam 905 is rotated, toward the closed position in which the portion 903 pinches the tube(s) closed. Thus, the movable portion 903 may also be referred to as a cam follower. When the actuator is moved in the opposite direction, the movable portion (or cam follower) 903 returns (e.g., under the resilience force of the pickup tube 154) to its nominal position shown in FIG. 9D. The rotation of the actuator may be limited by any suitable means. A hard stop 908-2 may be provided, e.g., projecting from the lower surface of the movable portion 903, to limits the rotation of the cam 905 when rotated in the direction opposite the closing (or pinching) direction. When rotating I the closing (or pinching) direction, the rotation of the cam 905 may be limited by a stop feature 905-2 (e.g., a notch) along the cam surface 905-1, which engages the nub 908-1 at a rotation position corresponding to the closed position.

As described, operation of the actuator (e.g., knob 107 and cam 905) moves the clamping sides of cam follower 903 towards the respective tube thereby selectively increasing the clamping (or squeezing) force on the tube(s). The cam follower 903 may be movably retained to the underside of the lid 904 by any suitable means. For example, as previously described, the cam follower 903 may be supported by the fixed portion 901 of the flow control mechanism or by the lid or other structure fixed to the lid. In the example in FIGS. 9D-9F, the cam follower 903 is movably supported by the actuator, and more specifically by the cam 905, which is sized/shaped for an interference fit with the slot 907, thus substantially inhibiting the cam follower 903 from moving downward (i.e., towards the interior of the container).

A flow control mechanism using a cam and follower mechanism according to the present disclosure is not only easy to use but relatively easy to manufacture, assemble, and maintain by an end user (e.g., clean) and provides a compact design. A cam and follower mechanism may be relatively easy to manufacture and maintain and may also enable the use of different cam profiles to affect different rates of motion of the cam follower, and consequently different rates of clamping of the flexible tube. For example, in some embodiments, the cam has a flat section that provides a wider range of rotation where the secondary liquid pickup tube is fully closed, which can improve the tactile feedback to the user when the mixture control knob is rotated to the closed position. In other examples, a cam-based or other suitable clamping mechanism may be used with an actuator that translates (e.g., slides) rather than rotates. For example, a similar cam mechanism as described above may be driven to the left and right to clamp or pinch the tube responsive to a slider rather than a rotatable knob. In other embodiments, the cam and follower mechanism may be used in conjunction with or replaced by a different mechanism such as a rack and pinion gear assembly that transmit the rotary actuation of the knob to a pinching force on the flexible tube 154 and/or tube 156. In yet other embodiments, the flow rate of the secondary liquid may be controlled without pinching the flexible tube but instead through resistance, such as may be created by controllably occluding the secondary vent hole, adjusting the suction force needed to draw liquid out of the secondary container, as described with reference to FIGS. 10-15 below.

Figure 10:
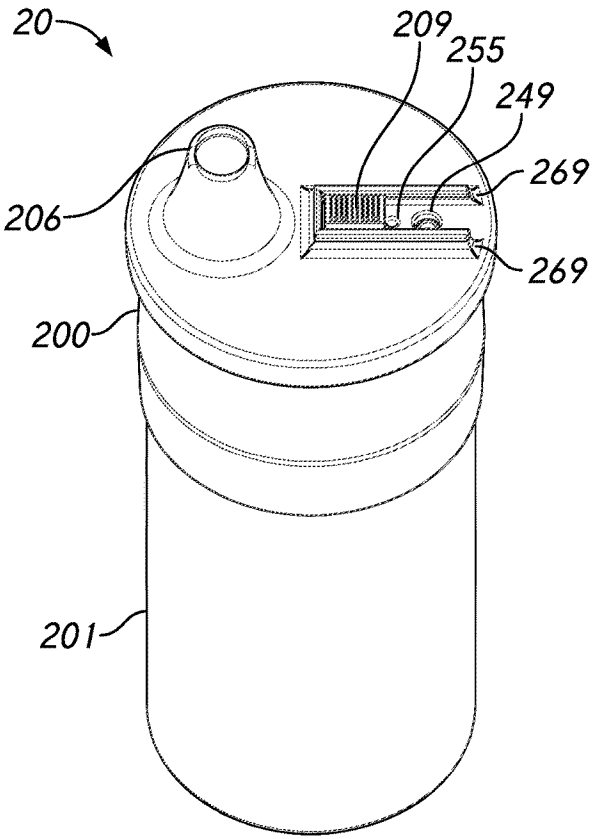
FIG. 10 is a perspective view of a secondary container according to further embodiments of the present disclosure, shown attached to a primary container to form another multi-compartment container.
Figure 13:
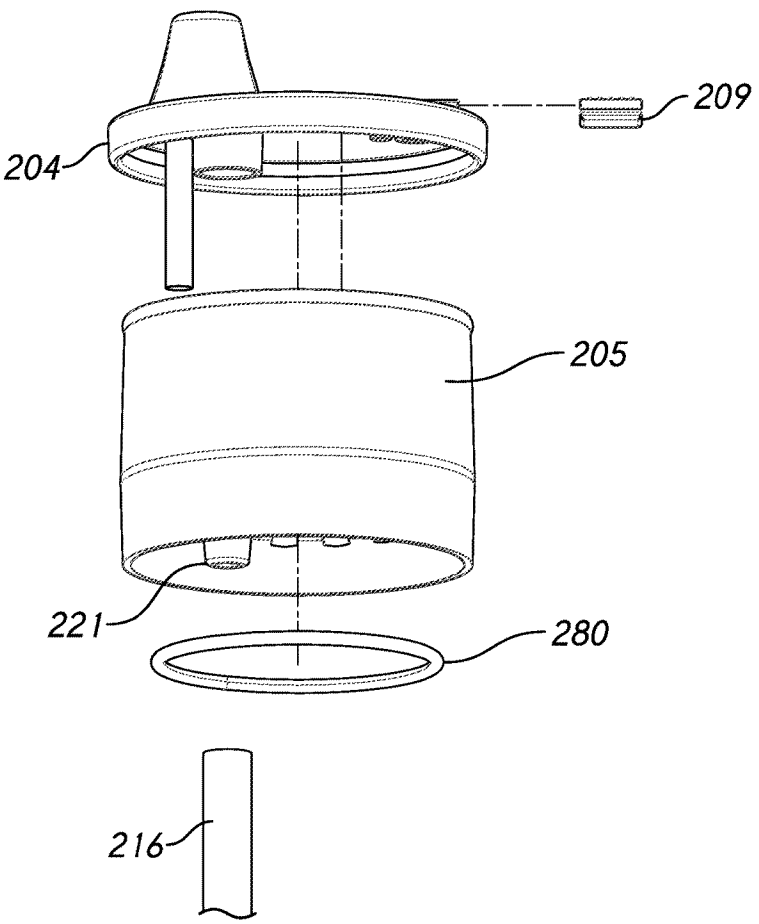
FIG. 13 is an exploded view of the secondary container of FIG. 10.

FIGS. 10-15 shows views of a secondary container 200 that is attachable to a primary container 201 to form a multi-compartment container 20 in accordance with further embodiments of the present disclosure. The secondary container 200 is attachable externally to the primary container 201. When attached to the primary container, as shown in FIG. 10, the secondary container 200 is positioned on top of and remains substantially outside of the primary container 201. The primary container 201 may be any suitable container such as a standard beverage can, a bottle, glass, mug, jug, tumbler, jar, or the like. The primary container 201 contains the primary liquid or beverage (e.g., juice or soda). The secondary container 200 contains the secondary liquid (e.g., a flavoring) separately from the primary liquid until the two liquids are mixed in the mixing chamber 261 of the secondary container 200 responsive to a user slurping or sucking on the spout 206 of the secondary container 200. The secondary container includes a main body 205 that defines a secondary chamber 242 (see FIG. 12), and a lid assembly (or simply lid) 204 that encloses or seals the secondary chamber 242.

Figure 11:
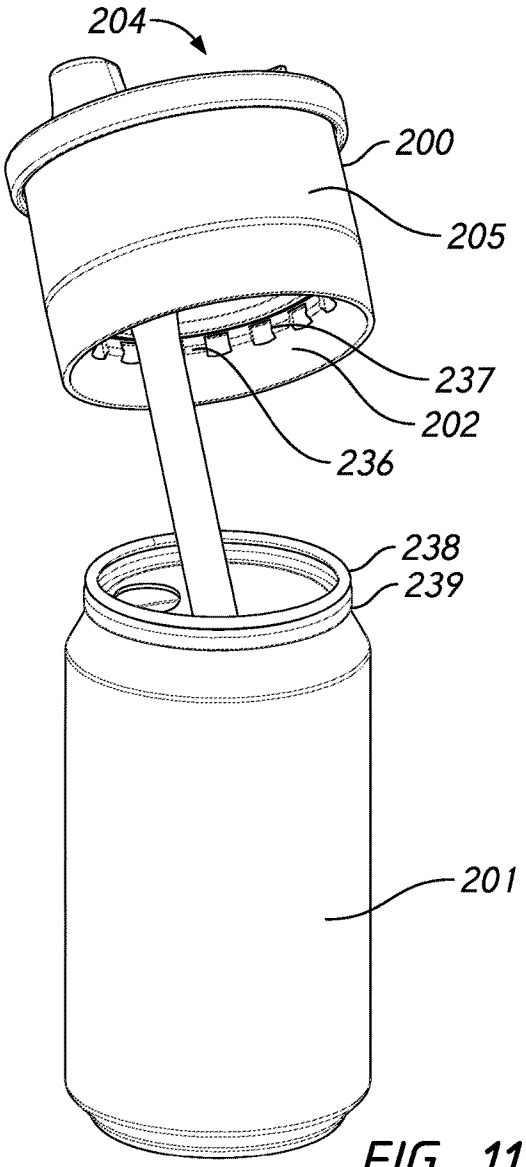
FIG. 11 is another view of the secondary container of FIG. 10 shown detached from the primary container.

FIG. 11 shows the secondary container 200 detached from the primary container 201 and rotated slightly to show the coupling interface 202 located on the bottom side of the secondary container 200. In FIG. 11, the primary container 201 is a standard beverage can (e.g., an aluminum can that contains soda, or other non-alcohol or alcohol containing beverage). In other embodiments, the primary container 201 may be a different type of container, for example a bottle, a jar, a mug, a glass or other container. The secondary container 200 includes a coupling interface 202 for attaching the secondary container 200 to the primary container 201. The coupling interface 202 is configured to couple via a snap-fit to the lip 238 of the primary container, shown here as a beverage can. In other embodiments, the primary container 201 may include a threaded interface near its rim and the secondary container 200 may be configured to threadedly couple thereto. In FIG. 11, the coupling interface 202 is provided by a can attachment ring 236 provided at the base of the secondary container 200. The coupling interface 202 is integral with the main body 205 of the secondary container. The coupling interface 202 includes a plurality of inwardly projecting flanges, shown here as an annular array of teeth 237 that project inward from the inner wall of the can attachment ring 236. The teeth 237 may, but need not, be equally spaced along the inner wall of the can attachment ring 236. The secondary container 200 is attached to the primary container 201 by positioning the can attachment ring 236 over the top lip 238 of the primary container 201 and urging the secondary container 200 toward the primary container 201. The teeth 237 engage the lip by resiliently snapping over the lip 238 of the primary container 201 and into the annular recess 239 formed below the lip 238, thus securing the secondary container 200 to the primary container 201.

Figure 12:
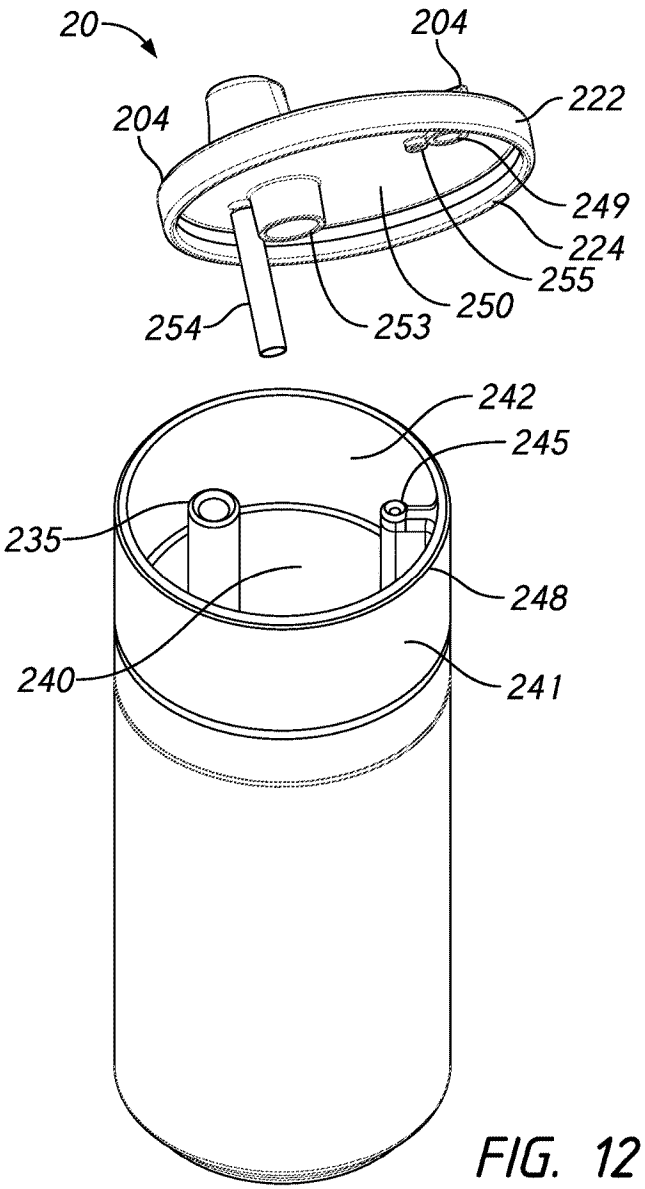
FIG. 12 is yet another view of the secondary container of FIG. 10 with the lid removed from the main body of the secondary container.

FIG. 12 shows a partially exploded perspective view of the multi-compartment container 20 with the lid 204 of the secondary container 200 removed from the main body 205 and rotated slightly to show internal features of the secondary container 200 and lid 204. The main body 205 may be implemented as a substantially rigid cup-shaped body. The upper portion of the main body 205 forms or defines the reservoir, also referred to as secondary chamber 242, for containing the secondary liquid. The secondary chamber 242 is defined by a sidewall 241 and bottom wall 240 and is enclosed by the underside of the lid 204. The lid 204 includes a substantially solid top portion (or simply top) 250 surrounded by a circumferential lower rim 222 that projects downward from the top 250. In this example, the rim 222 is integral with the top 250 but it may be separately formed and attached thereto, e.g., similar to lid 104 of the secondary container 100.

The lid 204 may include any suitable coupling interface for securely attaching the lid 204 to the main body 205. For example, an annular lip 224 may project inward from the lower rim 222 of the lid 204 for engagement with an annular lip 224 projecting outward from the outer wall of the main body 205. When the lid 204 is urged downward onto the main body 205, the annular lip 224 of the lid resiliently snaps over the annular lip 248 of the main body 205, sealably securing the lid 204 to the body 205. In other embodiments, the lid 204 may be securely attached to the main body 205 by cooperating threads operatively provided on the lower rim 222 of the lid 204 and the upper rim of the main body 205. Other suitable attachment features for securely attaching the lid 204 to the main body 205 may be used.

The main body 205 includes one or more pass-through structures that extend through the secondary chamber 242. A primary liquid pass-through 243 provides a channel for transmitting the primary liquid from the primary container 201 through the main body 205 to the mixing chamber 261, which in this embodiment is in the lid 204 of the secondary container 200. The channel of the primary liquid pass-through 243 connects the outlet of the primary liquid pick up tube 216 to the primary liquid inlet 262 of the mixing chamber 261 located in the lid 204. The outlet of the primary liquid pass-through 243 may be at the top of the secondary container body, whereby it is provided in fluid communication with the primary liquid inlet 262 of the mixing chamber 261 in the lid 204 when the lid 204 is attached to the main body 205. An optional pass-through 245 provides a primary container vent channel or passage which allows gas/vapor (e.g., air) to pass between the top of the primary container 201 and the top of the secondary container 200, when the two containers are attached to form the multi-compartment container 20. In other embodiments, the space between the primary container and the secondary container may be vented through an aperture located elsewhere on the secondary container. One or both of the primary liquid pass-through 243 and the optional pass-through 245 may be implemented by any suitable structure, e.g., a rigid cylindrical or differently shaped tube that may be integrally formed with the main body 205. The primary liquid pass-through 243 may have a lower opening located on a projection or barb 221 configured for coupling a flexible tube thereto. The optional pass-through 245 may have a lower opening positioned so that it remains within the interstitial space between the primary and secondary containers when the two are coupled together. For example, the lower opening of the optional vent pass-through 245 may be substantially flush with or project only slightly from the bottom side of the main body 205.

When the lid 204 is secured to the main body 205 of the secondary container 200, the primary liquid channel 253 in the lid fits circumferentially and sealably around the primary liquid pass-through 243 of the body. The optional primary container vent channel 249 in the lid fits circumferentially and sealably around the top of the primary container vent pass-through 245. A secondary liquid pickup tube 254 is either molded into or affixed to the primary container lid 204 to provide a channel for secondary liquid to be transmitted from near the bottom of the secondary container 200 to the secondary liquid channel 263 in the lid 204. A secondary container vent 255 allows air to enter the secondary container 200, such as to replace any of the secondary liquid drawn through the spout 206 out of the secondary container 200. A primary liquid pickup tube 216 can be affixed to the primary liquid barb 221 at the base of the secondary container body 205, providing a channel to conduct liquid from near the bottom of the primary container 201 to the primary liquid pass-through 243 in the secondary container 200. A resilient gasket or o-ring 280 (FIG. 13) may optionally be used to provide a seal between the primary container 201 and the secondary container body 205. In some embodiments, the secondary container may be configured to sealingly attach to the primary container without a gasket 280, and thus the gasket 280 may be omitted. To assemble the secondary container, the secondary container lid 204 can be snap-fit onto the secondary container body 204 after the secondary chamber 242 has been filled with a secondary liquid. To assemble the multi-compartment container 20 for use, the secondary container body 205, which in this example includes an integral can attachment ring 236, can be snap-fit onto the primary container 201.

A sliding cover 209 is slidably disposed to the top of the secondary container lid 204. The sliding cover 209 may be disposed in a track 269 such that it can slide between a fully open position in which the primary container vent 249 and secondary container vent 255 are fully exposed, as shown in FIG. 10, and a fully closed position in which both the primary container vent 249 and secondary container vent 255 are sealed. The sliding cover 209 may be slidable to any intermediate position between the fully open and fully closed positions. For example, the sliding cover 209 may be provided in a position in which it covers, partially or fully, the secondary container vent 255 but leaves the primary container vent substantially unobstructed. In this position, air is restricted or prevented from entering the secondary chamber 242 to replace secondary liquid which increases the resistance to drawing secondary liquid from the secondary chamber 242. The amount by which the secondary container vent 255 is obstructed by the sliding cover 209 may be used to control the flow of secondary liquid into the mixing chamber.

Figure 15:
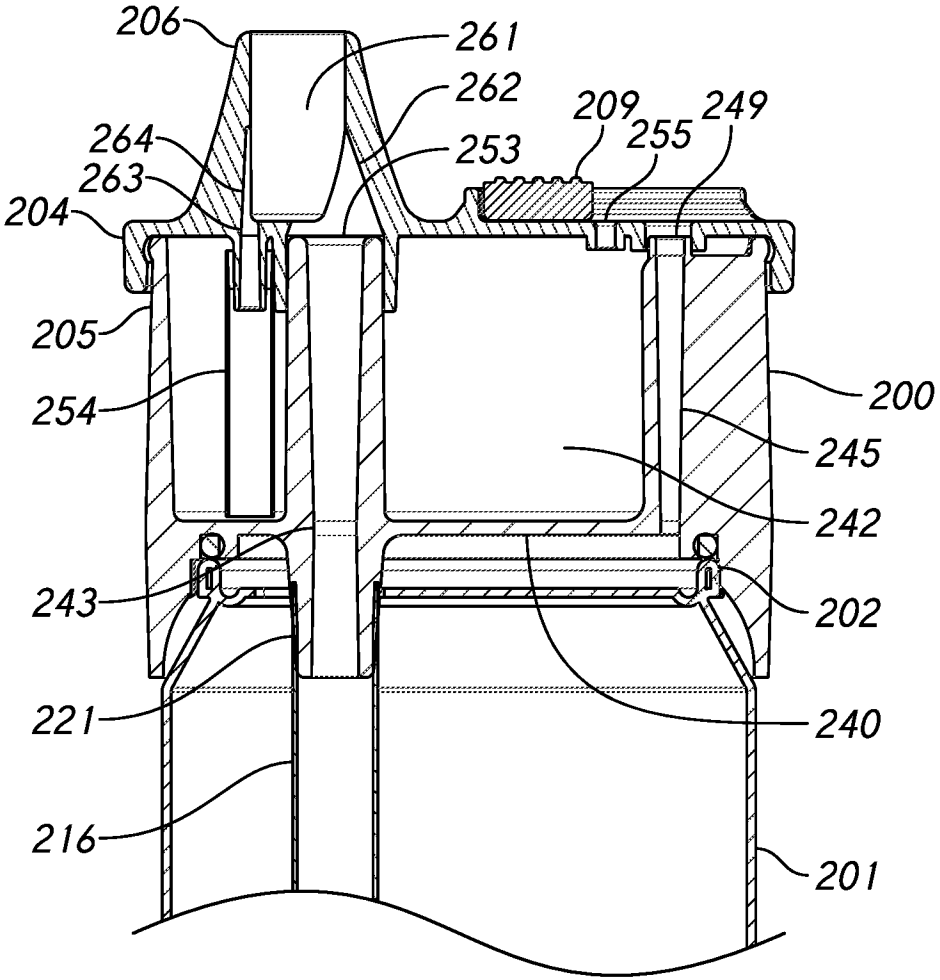
FIG. 15 is a section view of the secondary container of FIG. 10 taken at line 15-15 in FIG. 14.
Figure 14:
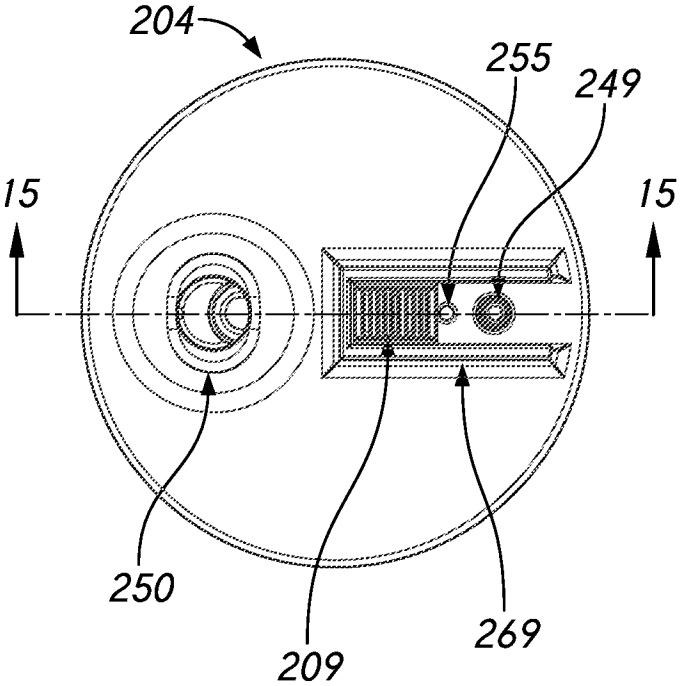
FIG. 14 is a top view of the secondary container of FIG. 10.

Referring also to the cross-sectional view in FIG. 15, in use, a mixture of the primary and secondary liquids is dispensed from the multi-compartment container 20 as a result of the user sucking on the outlet (e.g., spout 206) of the secondary container 200. The spout 206 in this example is a rigid structure which is integrally formed with the lid top 250. In other embodiments, the spout may be movably connected to the lid 204 and/or include a flexible portion. In use, when the user sucks on the spout 206, primary liquid is drawn from the base of the primary container 201, through the primary liquid pickup tube 216, through the primary liquid pass-through 243 of the secondary container body 205, through the primary liquid channel 253 of the secondary container lid 204, through the primary liquid inlet 262 into the mixing chamber 261. Simultaneously, this causes secondary liquid to be drawn from near the base of the secondary container 200, through the secondary liquid pickup tube 254, through the secondary liquid channel 263 of the lid 204, through the secondary liquid inlet 264 into the mixing chamber 261. The primary liquid and secondary liquid are mixed in the mixing chamber 261 and drawn out of the spout 206. Air is drawn through the secondary container vent 255 and into the secondary container 200 as secondary liquid is drawn out of the secondary container 200. If the optional primary container vent is present, air is drawn through the primary container vent 249, through the primary container vent pass-through 245 in the secondary container body 205, around the primary liquid pickup tube 216, and into the primary container 201 as primary liquid is drawn out of the primary container 201. The ratio of secondary liquid to primary liquid in the final dispensed mixture is controlled, in part, by the ratio of cross sectional area of the secondary liquid inlet 264 to the cross sectional area of the primary liquid inlet 262, and may be further controlled by selectively changing the amount by which one or both of the vents 249 and 255 are obstructed by the sliding cover 209. Additionally or alternatively, other flow restrictors, passive or actively adjustable, may be operatively associated with one or both of the primary and secondary liquid paths (e.g., the various channels, tubes or passages associated with transmitting the primary and secondary liquids).

Embodiments of the present disclosure include a primary liquid container and a secondary liquid container that are externally joined in order to form a multi compartment container. In some embodiments, the primary container is a standard aluminum beverage can. In other embodiments, the primary container is a plastic or glass bottle, a mug, a tumbler, a jar, or a drinking glass. The secondary container is attached to the primary container by a snap-fit attachment, threaded attachment, or other attachment mechanism.

The rigid components of the secondary container are made, in some embodiments, via an injection molding process, from a plastic material such as polypropylene (PP), styrene acrylonitrile (SAN), or polyethylene terephthalate glycol (PETG). In other embodiments, different materials such as glass or metal could be used for components of the secondary container. Various aspects of the secondary container in accordance with the present disclosure improve the ease of manufacture thereof, particularly when manufactured via an injection molding process, such as by eliminating undercut regions and facilitating appropriate draft angles.

The liquid in the primary container or "primary liquid" is mixed with the liquid in the secondary container or "secondary liquid" only when dispensed. A user draws both liquids simultaneously through a mixing chamber of the secondary container and out of the secondary container by slurping or sucking on a spout incorporated into the secondary container. The liquids are entrained and mixed within the mixing chamber as they are dispensed.

In the preferred embodiments, the secondary container comprises a cup-shaped body forming a reservoir, and a lid that is securely attached to, such as by being threaded or snap-fit onto, the body to close the reservoir. The secondary container includes a coupling interface for attachment of the secondary container to the primary container. In preferred embodiments, the coupling interface is configured to attach the secondary container externally to the primary container, such as by positioning the secondary container external to (e.g., on top of) the primary container. A primary liquid pickup tube extends from the base of the secondary container into the primary container. The secondary container may incorporate a pass-through for the primary liquid so that the primary liquid can be drawn from the primary container into the mixing chamber.

The ratio of primary liquid to secondary liquid in the dispensed mixture may be determined, in part, by the relative sizes of the apertures for dispensing the primary and secondary liquids into the mixing chamber, and also by the relative sizes of the primary and secondary liquid pickup tubes. Additionally and optionally, the ratio of primary liquid to secondary liquid in the dispensed mixture may be controlled via a metering control incorporated into the secondary container. In preferred embodiments, the metering control is configured to vary the mixture ratio of the liquids by restricting the flow of one or both of the liquids. In some embodiments, the restriction is performed by clamping, squeezing or flattening the secondary liquid pickup tube. In some embodiments, the clamping, squeezing or flattening may be achieved by the application of a clamping force by two movable components that move relative to the tube to squeeze the tube. In other embodiments, the tube may be clamped, squeezed or flattened by one movable component pressing the tube against a fixed structure. In other embodiments, instead of restricting the secondary liquid pickup tube, the flow through the primary liquid pickup tube may be varied such as by clamping, squeezing or flattening the primary liquid pickup tube. In yet other embodiments, a needle valve, ball valve, or other type of valve may be placed in-line with the primary or secondary pickup tube.

In some embodiments, the primary container is a standard aluminum beverage can having a flange or lip extending around the top of the can. According to an aspect of the disclosure, a can attachment ring may be affixed to the bottom of the secondary container. This can attachment ring has a flange projecting inward from the inner wall and designed to resiliently snap over and grab the flange or lip of the primary container. When engaged, this causes the secondary container to become attached to the primary container. According to another aspect, the flange of the can attachment ring may be cut away on two opposite sides such that in these cutaway regions the can attachment ring does not contact the primary container. When the outer wall of the can attachment ring is urged inward near these cutaway regions, the ring becomes deformed into an oblong shape. The cutaway regions become closer together and the remaining regions of the flange become farther apart. This deformation of the ring decreases contact area between the flange of the can attachment ring and the flange or lip of the primary container, thus decreasing the force required to separate the primary and secondary containers.

It will be understood that any one of the examples, embodiments or processes described herein may, unless stated otherwise, be combined with one or more other examples, embodiments and/or processes or be separated and/or performed amongst separate devices or device portions in accordance with the present systems, devices and methods Finally, the above discussion is intended to be merely illustrative of examples and should not be construed as limiting the appended claims to any particular embodiment or group of embodiments. Thus, while the present invention has been described in particular detail with reference to exemplary embodiments, it should also be appreciated that numerous modifications and alternative embodiments may be devised by those having ordinary skill in the art without departing from the broader and intended spirit and scope of the present system as set forth in the claims that follow. Accordingly, the specification and drawings are to be regarded in an illustrative manner and are not intended to limit the scope of the appended claims.

What is claimed is:

1. A mixing cup for attachment to a primary container containing a primary liquid, the mixing cup comprising:

a rigid main body that defines a secondary chamber for containing a secondary liquid;

a lid coupled to the main body for sealing the secondary liquid within the secondary chamber;

a mixing chamber integrated into the lid and in fluid communication with the primary container via a primary inlet and to the secondary chamber via a secondary inlet;

a flexible tube positioned within the secondary chamber and fluidly coupling the secondary chamber to the secondary inlet of the mixing chamber; and a flow control mechanism configured to adjust a ratio of fluids dispensed from the primary container and the secondary chamber, the flow control mechanism comprising an actuator, at least a portion of which is external to the secondary chamber, and a clamp positioned within the secondary chamber and operatively coupled to the flexible tube to selectively apply a clamping force to the flexible tube in response to manipulation of the actuator;

wherein the actuator is configured to be rotated to vary the clamping force applied to the flexible tube;

wherein the actuator comprises a knob and a cam rotatably mounted to the lid, and the flow control mechanism comprises a cam follower that moves responsive to movement of the cam to vary the clamping force applied to the flexible tube.

2. The mixing cup of claim 1, wherein the main body is positioned outside of the primary container when the mixing cup is attached thereto.

3. The mixing cup of claim 1, wherein the lid is removably coupled to the main body.

4. The mixing cup of claim 1, wherein the lid comprises one or more accessory attachment features.

5. The mixing cup of claim 1 further comprising a coupling interface on a side of the main body opposite the lid.

6. The mixing cup of claim 5, wherein the coupling interface comprises an annular body removably attached to the main body.

7. The mixing cup of claim 5, wherein the coupling interface comprises a circumferential seal that seals a perimeter of an interstitial space between the primary and secondary containers when the primary and secondary containers are attached to one another.

8. The mixing cup of claim 5, wherein the coupling interface comprises an annular wall, and a plurality of engagement features extending radially inward from the annular wall, wherein the plurality of engagement features are configured to hook under a top-side lip of a standard beverage can.

9. The mixing cup of claim 8, wherein the plurality of engagement features comprises a first flange and a second flange extending radially inward from diametrically opposite locations of the annular wall.

10. The mixing cup of claim 1, wherein the secondary container comprises a first pass-through that provides a first channel through the secondary chamber for transmitting primary liquid from the primary container to the lid.

11. The mixing cup of claim 10, wherein the first pass-through is a rigid structure integral with the main body.

12. The mixing cup of claim 10, wherein the secondary container further comprises a second pass-through structure providing a second channel through the secondary chamber, wherein the second channel is configured to connect an interstitial space between the primary and secondary containers when the primary and secondary containers are attached to one another to a vent opening in the lid.

13. The mixing cup of claim 1, wherein at least one of:

the lid comprises a spout immovably extending from a top side of the lid;

the mixing chamber is integral within the spout; and the primary inlet and the secondary inlet are on opposite sides of the mixing chamber.

14. The mixing cup of claim 1, wherein the lid comprises a secondary chamber vent, and wherein the secondary chamber vent is selectively opened and closed as a result of manipulation of the actuator.

15. The mixing cup of claim 1, wherein the cam is integral with the knob such that rotation of the knob causes synchronous rotation of the cam.

16. The mixing cup of claim 15, wherein the cam is inside the secondary chamber.

17. The mixing cup of claim 16, wherein the cam follower is slidably supported inside the secondary chamber.

18. The mixing cup of claim 17, further comprising a vent tube coupled to a vent opening in the lid, and wherein a first end of the cam follower is configured to apply the clamping force to the flexible tube and is fixedly joined to a second end of the cam follower proximate the vent tube such that the first and second ends concurrently to apply a clamping force to a respective one of the flexible tube and the vent tube in response to rotation of the cam.

19. A mixing cup for attachment to a primary container containing a primary liquid, the mixing cup comprising:

a rigid main body that defines a secondary chamber for containing a secondary liquid;

a lid coupled to the main body for sealing the secondary liquid within the secondary chamber;

a mixing chamber integrated into the lid and in fluid communication with the primary container via a primary inlet and to the secondary chamber via a secondary inlet;

a flexible tube positioned within the secondary chamber and fluidly coupling the secondary chamber to the secondary inlet of the mixing chamber;

a flow control mechanism configured to adjust a ratio of fluids dispensed from the primary container and the secondary chamber, the flow control mechanism comprising an actuator, at least a portion of which is external to the secondary chamber, and a clamp positioned within the secondary chamber and operatively coupled to the flexible tube to selectively apply a clamping force to the flexible tube in response to manipulation of the actuator; and a coupling interface on a side of the main body opposite the lid, wherein the coupling interface comprises a circumferential seal that seals a perimeter of an interstitial space between the primary and secondary containers when the primary and secondary containers are attached to one another.

20. A mixing cup for attachment to a primary container containing a primary liquid, the mixing cup comprising:

a rigid main body that defines a secondary chamber for containing a secondary liquid;

a lid coupled to the main body for sealing the secondary liquid within the secondary chamber;

a mixing chamber integrated into the lid and in fluid communication with the primary container via a primary inlet and to the secondary chamber via a secondary inlet;

a flexible tube positioned within the secondary chamber and fluidly coupling the secondary chamber to the secondary inlet of the mixing chamber;

a flow control mechanism configured to adjust a ratio of fluids dispensed from the primary container and the secondary chamber, the flow control mechanism comprising an actuator, at least a portion of which is external to the secondary chamber, and a clamp positioned within the secondary chamber and operatively coupled to the flexible tube to selectively apply a clamping force to the flexible tube in response to manipulation of the actuator; and a coupling interface on a side of the main body opposite the lid, wherein the coupling interface comprises an annular wall, and a plurality of engagement features extending radially inward from the annular wall, and wherein the plurality of engagement features are configured to hook under a top-side lip of a standard beverage can.

* * * * *